US009462388B2

(12) United States Patent
Unruh et al.

(10) Patent No.: US 9,462,388 B2
(45) Date of Patent: Oct. 4, 2016

(54) ACOUSTIC TRANSDUCER COMPRISING A PLURALITY OF COAXIALLY ARRANGED DIAPHRAGMS

(71) Applicant: Tymphany HK Limited, Wanchai (HK)

(72) Inventors: Andrew David Unruh, San Jose, CA (US); Robert J. True, Pleasant Prairie, WI (US); Edward T. Norcott, Jr., Los Gatos, CA (US); Jens-Peter Axelsson, Benicia, CA (US); Alireza Jabbari, Berkeley, CA (US); David J. Prince, Villa Park, IL (US); Kenneth L. Kantor, Berkeley, CA (US); Ioannis Kanellakopoulos, Cupertino, CA (US); Shaolin Wei, San Diego, CA (US)

(73) Assignee: TYMPHANY HK LIMITED, Wanchai (HK)

( * ) Notice: Subject to any disclaimer, the term of this patent is extended or adjusted under 35 U.S.C. 154(b) by 0 days.

(21) Appl. No.: 14/519,429

(22) Filed: Oct. 21, 2014

(65) Prior Publication Data

US 2015/0036868 A1 Feb. 5, 2015

Related U.S. Application Data

(62) Division of application No. 11/628,394, filed on Sep. 5, 2008, now Pat. No. 8,897,472.

(51) Int. Cl.
*H04R 25/00* (2006.01)
*H04R 7/08* (2006.01)
(Continued)

(52) U.S. Cl.
CPC *H04R 7/08* (2013.01); *H04R 7/16* (2013.01); *H04R 9/063* (2013.01); *H04R 7/20* (2013.01); *H04R 31/006* (2013.01); *H04R 2499/13* (2013.01)

(58) Field of Classification Search
CPC ..... H04R 7/08; H04R 7/16; H04R 7/18; H04R 7/20; H04R 7/26; H04R 9/025; H04R 9/063; H04R 9/066; H04R 11/02; H04R 23/02; H04R 31/006; H04R 2209/026; H04R 2400/13; H04R 2499/13; H04R 7/14
USPC ..... 381/152, 337, 162, 165, 182, 186, 396, 381/398, 401, 417, 418, 423, 424; 181/144, 181/145, 147, 163, 199
See application file for complete search history.

(56) References Cited

U.S. PATENT DOCUMENTS 1,273,459 A 7/1918 Chudzikowski
3,015,366 A 1/1962 Bishop
(Continued)

FOREIGN PATENT DOCUMENTS

DE 10217181 A1 11/2003
EP 0771133 A1 5/1997
(Continued)

OTHER PUBLICATIONS

International Preliminary Report on Patentability for corresponding application PCT/US2005/019443 filed Jun. 3, 2005; Report issued Dec. 4, 2006.
(Continued)

*Primary Examiner* — Huyen D Le
(74) *Attorney, Agent, or Firm* — Cantor Colburn LLP

(57) ABSTRACT

An acoustic transducer includes a housing, a plurality of diaphragms suspended from the housing and separated into one or more groups, and one or more motors combined with the housing that operate in response to an electrical signal. The diaphragms of each group are driven by a respective motor to which all the diaphragms in the group are coupled and at least one motor has an indirect coupling with no direct mechanical connection to the diaphragms driven thereby. One or more electromagnetic motors that drive one or more sets of multiple diaphragms to provide acoustically efficient loudspeaker systems having dimensions that allow use in applications that would be difficult or impossible with traditional transducers.

15 Claims, 24 Drawing Sheets

(51) Int. Cl.

| | |
|---|---|
| ***H04R 9/06*** | (2006.01) |
| ***H04R 7/16*** | (2006.01) |
| *H04R 7/20* | (2006.01) |
| *H04R 31/00* | (2006.01) |

(56) References Cited

U.S. PATENT DOCUMENTS

| | | | | |
|---|---|---|---|---|
| 3,636,278 | A | 1/1972 | Heil | |
| 4,029,171 | A | 6/1977 | Manger | |
| 4,039,044 | A * | 8/1977 | Heil | 181/144 |
| 4,107,479 | A | 8/1978 | Heil | |
| 4,122,314 | A | 10/1978 | Matsuda | |
| 4,473,721 | A | 9/1984 | Klein | |
| 6,242,994 | B1 * | 6/2001 | Li et al. | 335/277 |
| 6,778,677 | B2 * | 8/2004 | Coffin | H04R 9/045 381/401 |
| 7,190,247 | B2 | 3/2007 | Zimmerling | |

FOREIGN PATENT DOCUMENTS

| | | | |
|---|---|---|---|
| GB | 2058953 | A | 4/1981 |
| IT | 1197124 | B | 11/1988 |
| KR | 200013761 | A | 7/2000 |
| KR | 100265876 | B1 | 10/2000 |
| KR | 20000068694 | A | 11/2000 |
| KR | 20010103054 | A | 11/2001 |
| WO | 0041435 | A1 | 7/2000 |

OTHER PUBLICATIONS

International Search Report for corresponding application PCT/US2005/019443 filed Jun. 3, 2005; Mail date Oct. 27, 2005.

Written Opinion for corresponding application PCT/US2005/019443 filed Jun. 3, 2005; Mail date Oct. 27, 2005.

* cited by examiner

ACOUSTIC TRANSDUCER COMPRISING A PLURALITY OF COAXIALLY ARRANGED DIAPHRAGMS

CROSS-REFERENCE TO RELATED APPLICATIONS

The present invention is a divisional of U.S. patent application Ser. No. 11/628,394 filed Sep. 5, 2008, which is a National Phase entry of International Patent Application Number PCT/US05/019443 filed Jun. 3, 2005, which claims priority to U.S. Provisional Patent Application Ser. No. 60/576,990 filed Jun. 3, 2004, U.S. Provisional Patent Application Ser. No. 60/622,259 filed Oct. 25, 2004, U.S. Provisional Patent Application Ser. No. 60/641,620 filed Jan. 5, 2005, U.S. Provisional Patent Application Ser. No. 60/667,248 filed Apr. 1, 2005, and U.S. Provisional Patent Application Ser. No. 60/685,161 filed May 26, 2005, where the contents of all of said applications are herein incorporated by reference in their entirety.

TECHNICAL FIELD

The present invention is related to the field of audio systems and acoustics, and pertains more specifically to providing an improved form factor for an acoustic transducer that converts electrical signals into acoustic radiation.

BACKGROUND ART

The general principles of moving coil electrodynamic loudspeakers are well understood. Central to the ability of a transducer to generate sound is the concept of volume displacement. The volume displacement of a transducer with a single diaphragm is equal to the effective surface area of the diaphragm multiplied by the excursion capability of that diaphragm. The greater the volume displacement of a transducer, the greater its potential for generating sound. The need for large volume displacement is especially pronounced at low frequencies. The traditional methods for achieving greater volume displacement in a transducer are to increase the surface area of the diaphragm, to increase the excursion capability of the diaphragm, or both.

Traditional transducers that are used to produce significant low frequency energy incorporate a single diaphragm with a large surface area and use motors and housings that provide for adequate excursion of the diaphragm. This leads to certain minimum dimension requirements for the diaphragm of a loudspeaker, which in turn imposes minimum dimension requirements on the loudspeaker enclosure. It is very difficult to use traditional transducers with good low-frequency response in applications such as flat-panel television and computer monitors. In these applications, the current solution is to use a separate subwoofer box to reproduce low frequency sound, resulting in added cost and inconvenience. The same holds true of automotive sound system applications, where designers struggle to find a place to hide the subwoofer in the car, which is usually in the trunk or under the seats.

DISCLOSURE OF INVENTION

It is an object of the present invention to provide for an acoustic transducer that can reproduce low-frequency sound with high fidelity at high sound pressure levels in applications that cannot be addressed satisfactorily by traditional transducers.

According to one aspect of the present invention, the sound-producing surface area of an acoustic transducer is distributed across multiple diaphragms in a form factor that is much more suitable for use in applications such as flat panel television and computer monitors as well as automotive sound systems. These multiple diaphragms can be separated into one or more groups, with the diaphragms of each group being driven synchronously by at least one motor to which all the diaphragms in the group are connected. Any motor capable of converting electrical audio signals into motion can be used to drive the diaphragms in a group. For example, motors consisting of a moving voice coil and a non-moving magnet can be used.

The specific implementations of an acoustic transducer that are described herein either use a single motor that drives all the diaphragms or the housing to which all the diaphragms are mounted, or use each of two motors to drive half of the diaphragms. In principle, the number of motors is largely independent of the number of diaphragms. For example, an acoustic transducer may have one group of four diaphragms that is driven by two motors and another group of three diaphragms that is driven by one motor.

Each driving motor may be connected directly or indirectly to all the diaphragms that it drives. An indirect connection may be achieved by directly connecting the motor to a housing that is in turn connected to the diaphragms by their surrounds or suspensions, or by using a gas or liquid fluid to couple the motor to the diaphragms. All the motors in a particular acoustic transducer may receive essentially the same audio signal and can be connected either in series or in parallel with one another.

The materials that are used in the construction of various implementations of the present invention may be materials that are used in the construction of typical acoustic transducers. The housing, connecting rods and motors may be made of materials whose modes of resonance, vibration, or flexure have characteristic frequencies that are outside the audio spectrum of interest. Since these components preferably are not part of the sound generation mechanism, the use of materials with modes in the audio spectrum of interest could result in unwanted audio artifacts. Preferably, moving elements such as the diaphragms and connecting rods are made of materials that are as light as possible to improve the efficiency of the device. For example, a glass-filled or mica-filled polypropylene-polyphenylene-oxide-styrene material or a carbon-fiber material may be used.

The implementations described herein utilize a tubular form factor with a cylindrical housing and round diaphragms; however, the cross-sections of the housing and the diaphragms do not have to be round. They could be oval, rectangular or essentially any other shape that may be desired.

The increased complexity and additional parts needed to implement various aspects of the present invention may increase manufacturing costs and reduce reliability of the transducer. These problems can be mitigated or avoided by employing a modular design where, for example, one type of module, referred to herein as a motor module, contains a magnet assembly, a coil, and a diaphragm or cone, and another type of module, referred to herein as a diaphragm module, contains a section of the housing, a diaphragm, a suspension, and a set of rods that are coupled to the diaphragm. The motor module is designed to mate with a diaphragm module and may contain a set of rods that mechanically couple the motor in the motor module to the diaphragm in the adjacent diaphragm module. Alternatively, the motor module may contain a diaphragm that fluidically couples to the diaphragm in the adjacent diaphragm module. A diaphragm module is designed also to mate with another diaphragm module. Essentially any number of the diaphragm modules can be assembled into a linear array of modules. The rods in each diaphragm module pass through openings in the immediately adjacent diaphragm module and mechanically connect to the diaphragm in the next diaphragm module. The section of housing in each of the diaphragm modules is adapted to mate with the section of housing in adjacent diaphragm modules to form a chamber between modules. The air in a respective chamber is either acoustically isolated from the air outside the housing or it is acoustically coupled to the air outside the housing through a port, vent or other opening.

An acoustic transducer according to the present invention produces a front wave and a rear wave. It is anticipated that the transducer usually will be enclosed by a housing having openings appropriately oriented with respect to a listener through which the front wave may exit. There are many well-known methods for dealing with the rear wave in standard acoustic transducers and any of those methods can be used in the present invention. For example, the rear wave can be vented through a transmission line that introduces delay, it can be vented into a large enclosure that acts as a baffle, or it can be vented directly into the surrounding air. The latter method generally reduces the audio efficiency of the transducer in the low frequencies.

The overall size of an acoustic transducer according to the present invention is highly dependent on the desired level of audio efficiency at low frequencies. Higher audio efficiency can be achieved either by increasing the surface area of individual diaphragms, by increasing the excursion of individual diaphragms, by increasing the number of diaphragms, by optimizing the acoustic impedance matching between diaphragms and air, or by any combination of these factors.

According to one teaching of the present invention, the transducer includes a single motor actuating multiple diaphragms by using a single drive rod that is attached to each diaphragm. One side of each diaphragm faces an opening to the listening environment. The other side of each diaphragm is isolated from the listening environment by a baffle. The drive rod may pass through openings in the baffles and/or in the diaphragms. Seals may be used to prevent or substantially reduce unwanted air leakage in any openings through which the drive rod may pass.

According to another teaching of the present invention, the transducer includes two motors, each actuating multiple diaphragms. The diaphragms are arranged in two groups; diaphragms in one group are driven by one motor and diaphragms in the other group are driven by the other motor. Preferably, the groups of diaphragms are driven in opposition to one another. The diaphragms are actuated by the motors using drive rods. The drive rods may pass through openings in the baffles and/or in the diaphragms. Unfortunately, air can leak through these openings and cause large amounts of intermodulation and harmonic distortion. This leakage can also significantly reduce sound output levels. Seals may be used to prevent unwanted air leakage in any openings in the diaphragms including those through which the rods may pass.

These seals may be formed from one or more pieces of lightweight foam, each piece of which is compressible and expandable and affixed to a rod near an opening. A piece of foam is compressed when the rod pushes it toward the opening, and it expands when the rod pulls it away from the opening. These seals may also be made of a pleated fabric such as the fabric used in bellows, which can expand and contract as needed. Alternatively, the drive rods may be routed in such a way that they do not pass through any diaphragms or baffles, thereby eliminating the need for seals.

For those implementations having drive rods passing through diaphragms and/or baffles, it may be desirable to avoid the use of seals because the seals add cost and complexity to the implementation. This may be achieved by designing the size of the opening in the diaphragms and/or baffles through which drive rods pass to optimize overall performance. These openings are referred to herein as "pass-through openings." Any air leakage through the pass-through openings in the diaphragms may generate undesirable artifacts in the form of audible distortion or noise and/or a reduction in the overall volume displacement of air. These air leakage artifacts can be reduced by increasing the resistance of the opening to air flow or by diffusing the air that passes through the openings so that it generates less audible noise. The resistance can be increased, for example by increasing the length of the path through which the air has to travel or by reducing the size of the opening. Several techniques for reducing the air leakage noise are described in the following paragraphs; these techniques may be used individually or in combination to achieve the desired outcome.

According to one technique, the resistance to air flow is increased by using thicker diaphragms to increase the length of the air travel path. This typically has the effect of increasing the mass of the diaphragms and reducing the maximum excursion for a given overall transducer volume.

According to another technique, the diaphragm thickness is increased by using a "sandwich" of two diaphragms with a layer of damping material such as a visco-elastic polymer between them. The resulting composite diaphragm is highly damped, which is often desirable in acoustic transducers because it can help reduce sonic artifacts. The presence of the damping material allows the diaphragms to be formed from a much lighter material, thereby mitigating an undesirable increase in the moving mass of the transducer.

According to another technique, the diaphragm thickness is increased by using a "sandwich" of a skin material that doesn't stretch, such as paper, and a lightweight spacing material such as polyurethane foam. The resulting composite diaphragm is typically lighter and stiffer than a monolithic diaphragm.

According to another technique, the resistance to air flow is increased by adding cylindrical "sleeves" to the diaphragms around the pass-through openings. The use of sleeves has the added effect of minimizing the increase in diaphragm mass. It may be preferable for the sleeves to be shaped differently on the two sides of the diaphragm. For example, on the outside face of the diaphragm, which transmits the front wave of the sound that is heard by the listener, the cylindrical sleeve may be shaped like a funnel to reduce the turbulence noise of the air that passes through the openings.

According to another technique, resistance to air flow is increased by adding sleeves made of an airflow resistant material around the pass-through openings. The inner diameter of these sleeves may be small enough that the sleeve fits somewhat tightly around the drive rod passing through the opening. The material used for these sleeves is preferably soft and slippery to reduce undesirable friction noise when the sleeve comes into contact with the drive rod, and possesses an airflow resistance sufficient to reduce the amount of air that passes through the opening. Examples of suitable materials include fabrics made of silk, polyester, soft wool, and other materials in combination with an elastic weave. These soft fabric sleeves are preferably mounted around shorter cylindrical sleeves made of a hard material such as plastic or metal.

Another method for reducing air leakage noise is to seal the pass-through openings with a material that effectively stops air flow while minimizing friction and noise. Examples of such materials include bellows made of soft and flexible fabric, and semifluid lubricants such as thixotropic gels. A similar effect can be achieved by using a ferromagnetic liquid between the rod and the sleeve. The ferromagnetic liquid may be held in place by a thin ring magnet that is attached to the diaphragm.

Another method for reducing air leakage noise is to diffuse the air that passes through the opening. One technique for achieving this is to add soft foam at the exit point of the air travel path. In particular, a cylinder of soft foam may be added either directly around the pass-through opening or indirectly around a shorter cylindrical sleeve made of a hard material such as plastic or metal. The foam may be configured so that it extends above the hard sleeve and curves inward so that it covers the opening and nearly touches the drive rod. The foam may be polyurethane reticulated open cell foam, which has the desirable properties of diffusing the air while reducing unwanted friction noise when it comes into contact with the drive rod. In some applications it may be preferable to place foam only on the inside face of the diaphragm, which transmits the rear wave of the sound that is not heard by the listener. This makes it possible to use longer foam sleeves with a smaller inside diameter. These foam sleeves may touch the drive rods more tightly so that they increase resistance to air flow in addition to diffusing the air that passes through the opening. The tighter touching of the drive rods will increase friction noise but that noise is contained in the rear wave and is therefore less objectionable to the listener.

The air leakage noise may be reduced through a combination of the techniques mentioned above; namely, adding sleeves to the diaphragm and increasing the thickness of the diaphragm itself.

An example of such a combined technique increases the resistance to air flow by forming a composite diaphragm consisting of a sandwich of two diaphragms, each having cylindrical sleeves around the pass-through openings on its outside face only, with a layer of damping material between them. The reduction in air leakage noise, the amount of increase in the moving mass and the amount of diaphragm damping can be customized to fit almost any application by adjusting the thickness of the damping material layer, the thickness of the component diaphragms and the length of the sleeves.

Another example of a combined technique for reducing air leakage artifacts is adding both soft foam and soft fabric sleeve around the pass-through openings. In particular, the soft foam may be added around the hard sleeve and the soft fabric may be added around the foam, thereby combining the effects of increasing resistance to air flow and diffusing the air that passes through the opening.

Another example of a combined technique for reducing air leakage artifacts is to use a tight bushing around the rod. The bushing is preferably made of a very low friction material such as a self-lubricating polymer. The bushing is preferably attached to the diaphragm via a flexible airtight material to allow limited movement and isolate the diaphragm from vibration.

The techniques described above for reducing air leakage noise are applicable to any transducer that uses a diaphragm or cone with a hole in it. These techniques are not limited to array transducers that use multiple diaphragms.

According to yet another teaching of the present invention, the transducer includes a motor that directly actuates one or more structures each containing a number of diaphragms that are suspended by surrounds, spiders, or other forms of suspension. The back wave of each diaphragm is acoustically isolated from adjacent diaphragms by baffles. The front wave of each diaphragm is allowed to pass through an opening to the listening environment. No drive rods are used and instead the diaphragms are driven inertially. This teaching may be extended to use multiple motors. In addition, different structures may be moved in opposition to one another.

According to a further teaching of the present invention, each driving motor is connected mechanically to a single diaphragm. That diaphragm is coupled by a fluid to another diaphragm, which in turn may be coupled mechanically to other diaphragms. In this way, one or more conventional loudspeakers can be used to drive multiple diaphragms indirectly. If a pneumatic fluid coupling such as an air coupling is used between the directly driven diaphragm and the indirectly driven diaphragms, the indirectly driven diaphragms operate as if they are driven by a signal that is passed through a filter with a low pass characteristic, while the directly driven diaphragm operates as if it is driven with a signal having a full frequency range. In an embodiment such as this, the directly driven diaphragm generates most of the high frequency sounds and the indirectly driven diaphragms generate most of the low frequency sounds.

According to yet a further teaching of the present invention, a transducer with a housing comprises a plurality of diaphragm modules each having a section of the housing, a diaphragm suspended from the section of the housing, and a set of one or more rods coupled to the diaphragm. The section of housing for a respective diaphragm module has a first surface and an opposing second surface. The first surface of the section of housing in one diaphragm module is designed to mate with the second surface of the section of housing in another diaphragm module in such a way that a chamber is formed between respective diaphragms of adjacent modules. The section of housing for a module may have ports, vents or other types of openings that allow air inside the chamber to be acoustically coupled to air outside the chamber. The rods in each diaphragm module pass through openings in the immediately adjacent diaphragm module and mechanically connect to the diaphragm in the next diaphragm module. In one implementation, the set of rods in one module protrude from one surface of the diaphragm and the opposite surface of the diaphragm has fixtures that are adapted to receive and mate with the ends of the rods of the module next to the adjacent module. In another implementation, a first set of rods protrude from one surface of a respective diaphragm and a second set of rods protrude from the opposite surface of the diaphragm. The ends of the rods in the two sets are adapted to mate with one another.

According to yet another teaching of the present invention, the diaphragm modules mentioned above do not have rods coupled to the diaphragm. Each diaphragm module consists of a section of the housing and a diaphragm suspended from the section of the housing. After the middle section of a transducer is assembled from a plurality of these diaphragm modules, rods are inserted and attached to the appropriate diaphragms with a bonding process such as gluing or sonic welding and one or more motor modules are attached to the ends of the middle section of the transducer.

In any of the implementations described above, sleeves may be added around pass-through holes or the diaphragm may be a composite diaphragm composed of two diaphragms with a layer of damping material sandwiched between them. The sandwich diaphragm may also incorporate cylindrical sleeves on one or both of its faces to reduce undesirable air leakage noise.

In any of the implementations described above, the diaphragm suspensions need not all have identical properties or orientations. For example, in implementations that drive diaphragms directly, it may be desirable to use stiffer suspensions near the motors to minimize movement in directions other than along the direction of the actuated drive rods. Furthermore, by orienting the suspensions of diaphragms that are actuated by a single motor so that some of the suspensions face in an opposite direction with respect to other suspensions, asymmetrical characteristics of the suspensions may be cancelled or reduced so that distortion characteristics of the transducer may be reduced.

The various features of the present invention and its preferred embodiments may be better understood by referring to the following discussion and the accompanying drawings. The contents of the following discussion and the drawings are set forth as examples only and should not be understood to represent limitations upon the scope of the present invention.

DETAILED DESCRIPTION

A. Direct Drive

Figure 1:
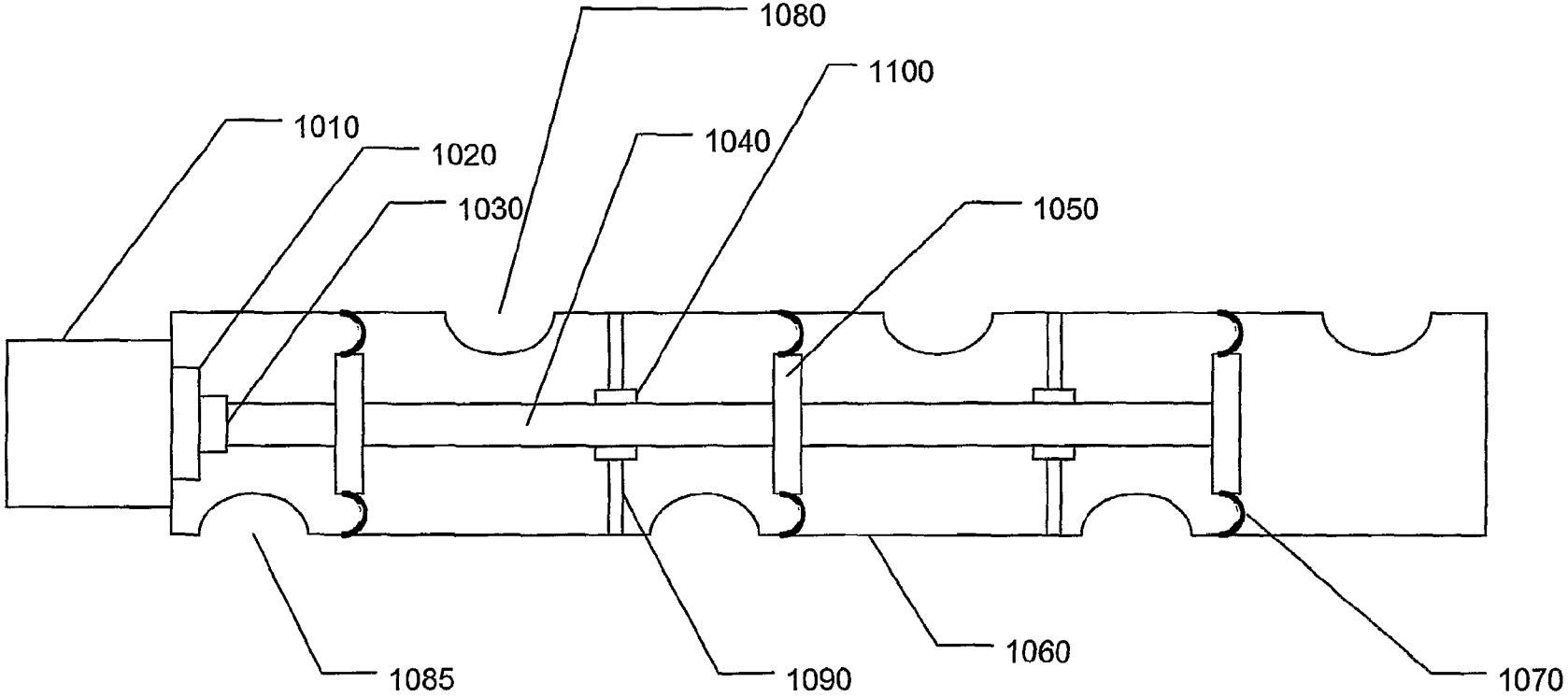
FIG. 1 is a schematic illustration of an implementation of the present invention using baffles, a single internal drive rod and a single motor.

FIG. 1 shows one implementation of the invention in which an electromagnetic motor comprises a magnet 1010 and a voice coil 1020 to which is mounted a mechanical coupling 1030 that is coupled to a drive rod 1040. The drive rod is attached to the diaphragms 1050, each of which are in turn attached to the housing 1060 by a respective suspension 1070. When an audio signal is applied to the voice coil, the sound waves from one side of the diaphragms are allowed to radiate to the listening environment through the openings 1080. The sound waves from the other side of the diaphragms are allowed to radiate from another set of openings

1085. Unwanted air leakage is prevented or reduced substantially by the baffles 1090 and the seals 1100. If desired, one or more bushings may be used in the motor to prevent undesirable voice coil motion. Alternatively, the drive rod 1040 can pass through some or all of the diaphragms 1050 without using seals. The size of the space between the diaphragms and the rods can be optimized to minimize air leakage while minimizing friction between the rods and the diaphragms.

Figure 2:
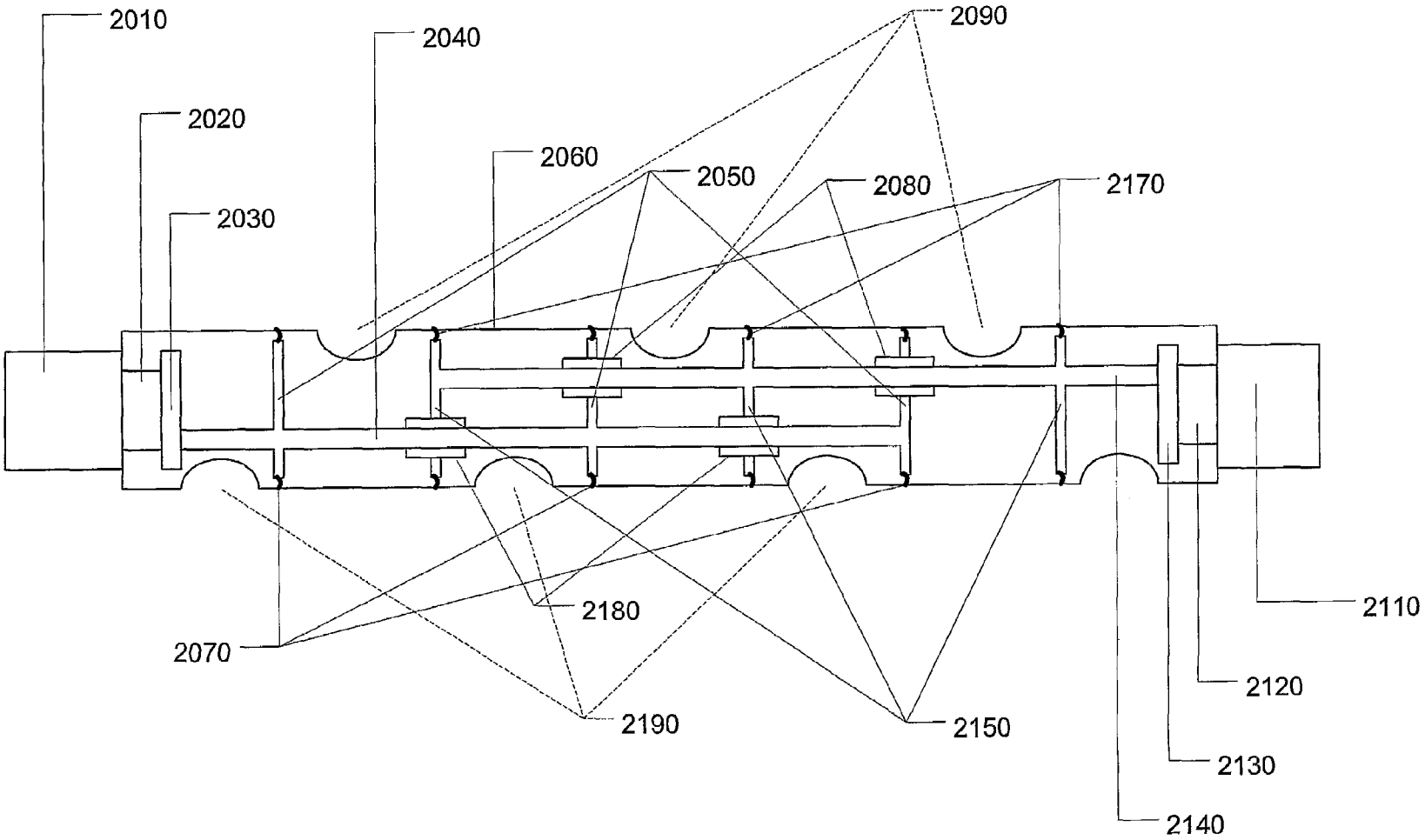
FIG. 2 is a schematic illustration of an implementation of the present invention using no baffles, multiple internal drive rods and two motors.

FIG. 2 shows one implementation of the invention in which an electromagnetic motor comprises a magnet 2010 and a voice coil 2020 to which is mounted a mechanical coupling 2030 that is coupled to a drive rod 2040. The drive rod 2040 is attached to the diaphragms 2050, each of which are in turn attached to the housing 2060 by a respective suspension 2070. The suspensions 2070 need not all have identical properties. It may be desirable, for example, to use stiffer suspensions near the voice coil to minimize movement of the voice coil in directions other than along the direction of the actuated drive rod. The stiffness of the suspensions 2070 may be controlled by manipulating suspension geometry or material. Furthermore, by orienting the suspensions of the diaphragms that are actuated by a single motor so that they face opposite directions, distortion characteristics of the transducer may be reduced. In this particular implementation, the drive rod 2040 passes through all but one of the diaphragms 2150 via openings that are sealed by the seals 2180. A different motor comprises a magnet 2110 and a voice coil 2120 having a mechanical coupling 2130 that is coupled to a drive rod 2140. The drive rod 2140 is attached to the diaphragms 2150, each of which are in turn attached to the housing 2060 by a respective suspension 2170. In this particular implementation, the drive rod 2140 passes through all but one of the diaphragms 2050 via openings that are sealed by the seals 2180. The voice coils 2020 and 2120 are connected so that each diaphragm works in opposition to the diaphragms next to it. When an audio signal is applied to the transducer, the sound waves from the front of the diaphragms are allowed to radiate to the listening environment through the openings 2090. Leakage between the front wave and rear wave is prevented or reduced substantially by the seals in the diaphragms. The rear wave is allowed to radiate through openings 2190. Alternatively, the drive rods 2040 and 2140 can pass through some or all of the diaphragms 2050 and 2150 without using seals. The space between the diaphragms and the rods can be optimized to minimize air leakage while minimizing friction between the rods and the diaphragms. The net change of momentum of the mechanical parts in this implementation of the invention is zero or substantially zero after taking into account variations in the parts due to manufacturing tolerances; therefore, the transducer housing 2060 will be essentially free of vibrations.

Figure 3:
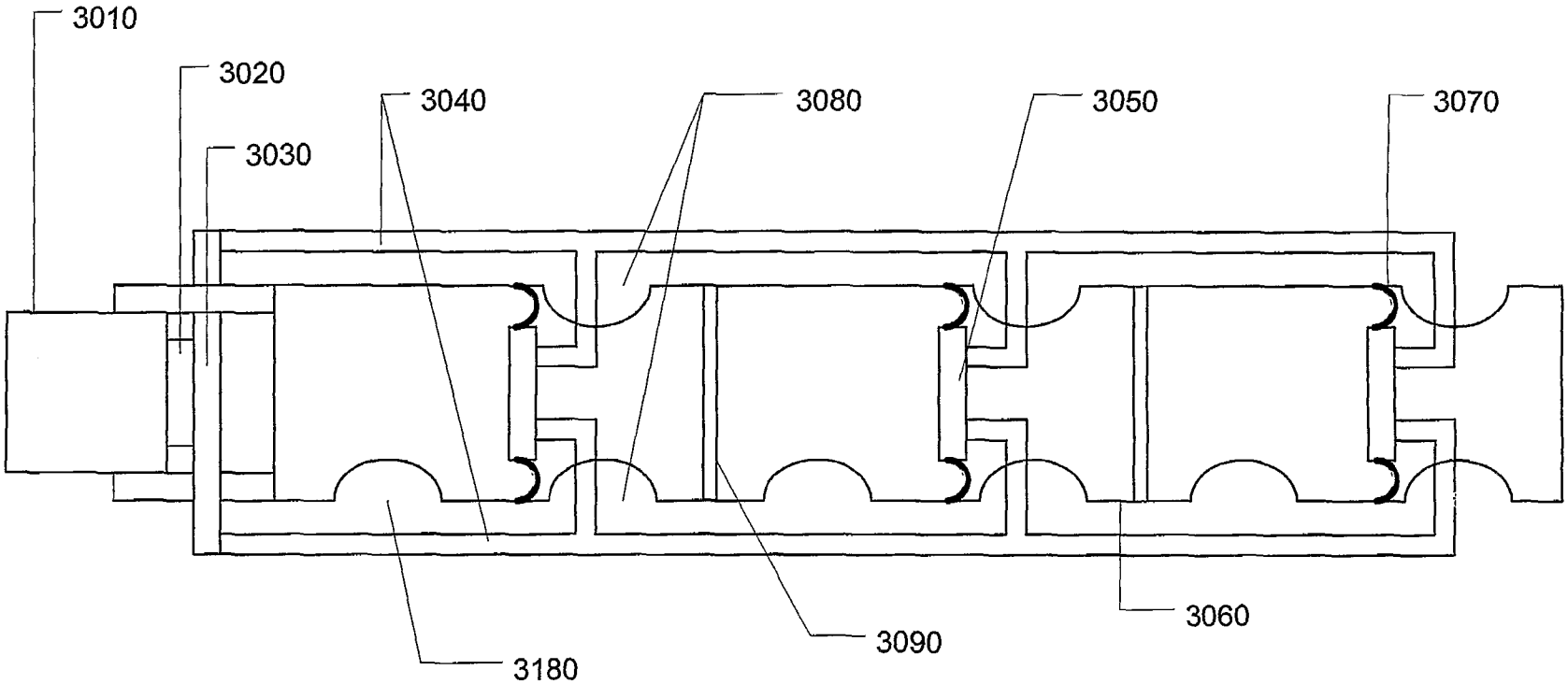
FIG. 3 is a schematic illustration of an implementation of the present invention using baffles, multiple external drive rods and a single motor.

FIG. 3 shows one implementation of the invention in which an electromagnetic motor comprises a magnet 3010 and a voice coil 3020 that is mounted to a mechanical coupling 3030 to which are coupled two drive rods 3040. The drive rods 3040 are attached to the diaphragms 3050, which in turn are attached to the housing 3060 by the suspensions 3070. When an audio signal is applied to the transducer, the sound waves from one side of the diaphragms are allowed to radiate to the listening environment through the openings 3080. The sound waves from the other side of the diaphragms are allowed to radiate through the openings 3180. Unwanted air leakage between the individual chambers is prevented or reduced substantially by the baffles 3090.

Figure 4:
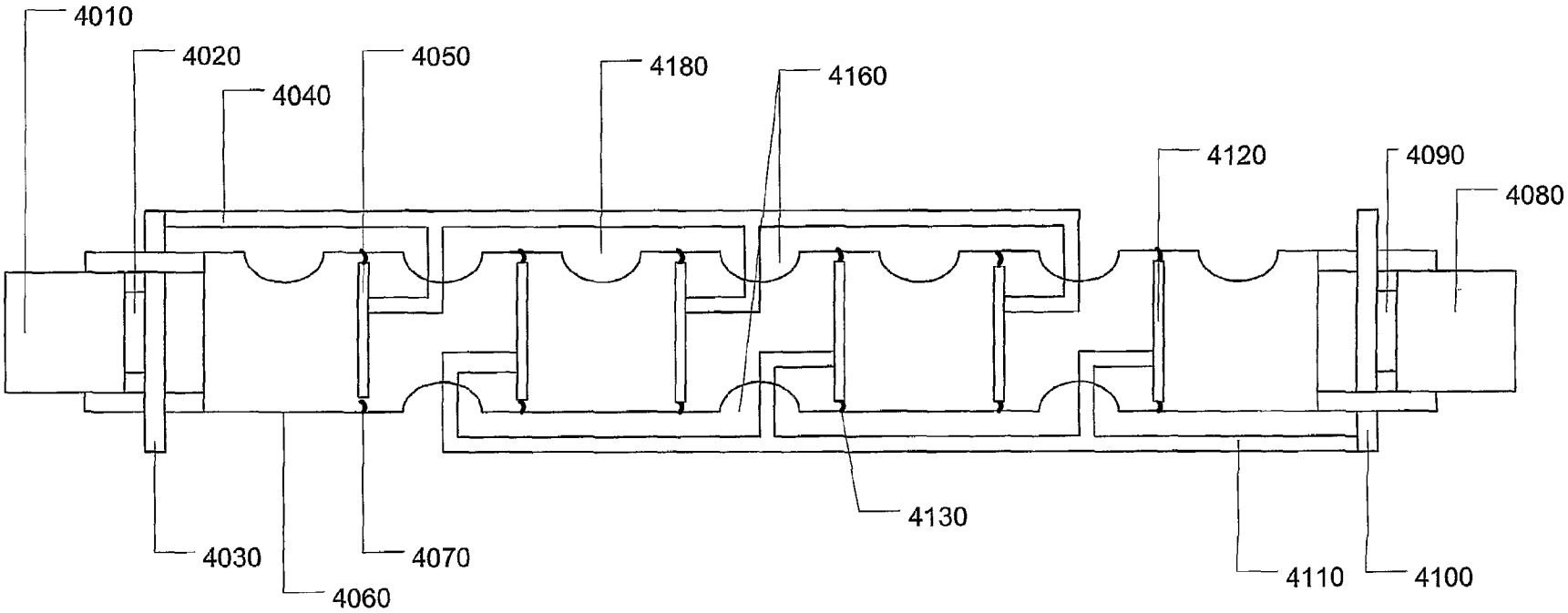
FIG. 4 is a schematic illustration of an implementation of the present invention using no baffles, multiple external drive rods and two motors.

FIG. 4 shows one implementation of the invention in which an electromagnetic motor comprises a magnet 4010 and a voice coil 4020 that is mounted to a mechanical coupling 4030, which is coupled to a drive rod 4040. The drive rod 4040 is attached to the diaphragms 4050, which are in turn attached to the housing 4060 by the suspensions 4070. A different motor comprises a magnet 4080 and a voice coil 4090 having a mechanical coupling 4100 that is coupled to a drive rod 4110. The drive rod 4110 is attached to the diaphragms 4120, which are in turn attached to the housing 4060 by the suspensions 4130. The voice coils are connected so that each diaphragm works in opposition to the diaphragms adjacent to it. When an audio signal is applied to the transducer, the sound waves from the front of the diaphragms are allowed to radiate to the listening environment through the openings 4160. The sound waves from the rear of the diaphragms are allowed to radiate through the openings 4180. The net change of momentum of the mechanical parts in this implementation of the invention is zero or substantially zero after taking into account variations in the parts due to manufacturing tolerances; therefore, the transducer housing will be essentially free of vibrations.

The main difference between the implementations illustrated by FIG. 2 and FIG. 4 is the configuration of each rod that drives half of the diaphragms in the transducer. Another implementation of the present invention uses two groups of rods, with each group comprising multiple rods. Each group of rods is connected to half the diaphragms and passes through the other half of the diaphragms. For example, the implementations illustrated in FIGS. 7-10 use six rods that are symmetrically distributed in a circular pattern around the center of the diaphragms and adjacent rods are displaced from one another by an angle of 60 degrees. The six rods are divided into two groups of three rods, and the rods in these two groups are interlaced with respect to each other. This means that the three rods in each group are symmetrically distributed in a circular pattern at equal distance from the center of the diaphragms and adjacent rods in the group are displaced from one another by an angle of 120 degrees. Each group of three rods is attached to half the diaphragms and passes through the other half of the diaphragms via sealed or unsealed openings in a fashion similar to that described above for the rods 2040 and 2140 and illustrated in FIG. 2. In this arrangement, each diaphragm is actuated in a symmetric fashion by three rods whose three points of attachment to the diaphragm are symmetrically distributed and define a unique two-dimensional plane in three-dimensional space. If the rods and diaphragms are properly aligned so that all the rods are parallel to each other, all the diaphragms are parallel to each other, and all the rods are perpendicular to the surface of all the diaphragms, then the diaphragms will be subjected to a symmetrically distributed normal force that will tend to move them in the desirable longitudinal direction without exciting any undesirable vibrational modes that may result in undesirable sonic artifacts.

Another implementation of the present invention uses one rod and one tube that are concentric. The outer diameter of the rod is smaller than the inner diameter of the tube so that, when they are mounted in a concentric fashion, the rod does not touch the tube. The rod is attached to a first set of diaphragms consisting of half of all the diaphragms in the transducer and passes through one or more diaphragms in a second set of diaphragms consisting of the other half of the diaphragms. The tube is attached to the diaphragms in the second set of diaphragms and passes through one or more diaphragms in the first set of diaphragms. The rod passes through diaphragms in the second set of diaphragms by virtue of the fact that it is wholly contained inside the tube. The tube is composed of multiple sections that are connected to one another one or more connecting rods that pass through openings in the diaphragms of the first set. Preferably, three connecting rods are symmetrically distributed across the circumference of the tube sections.

For any of the direct-drive implementations described herein, the diaphragm suspensions need not all have identical properties or orientations. For example, it may be desirable to use stiffer suspensions near the motors to minimize movement in directions other than along the direction of the actuated drive rods. The stiffness of the suspensions may be controlled by manipulating suspension geometry or material. Furthermore, by orienting the suspensions of diaphragms that are actuated by a single motor so that some of the suspensions face in an opposite direction with respect to other suspensions, asymmetrical characteristics of the suspensions may be cancelled or reduced. In typical implementations, suspensions have an asymmetrical response to the forces generated by the driving motor. An asymmetrical response typically introduces distortion into the resulting sound wave generated by the moving diaphragms. By reversing the orientation of some of suspensions, the asymmetry of the overall suspension response may be reduced, thereby reducing distortion in the resulting sound wave.

B. Indirect Drive

Figure 5:
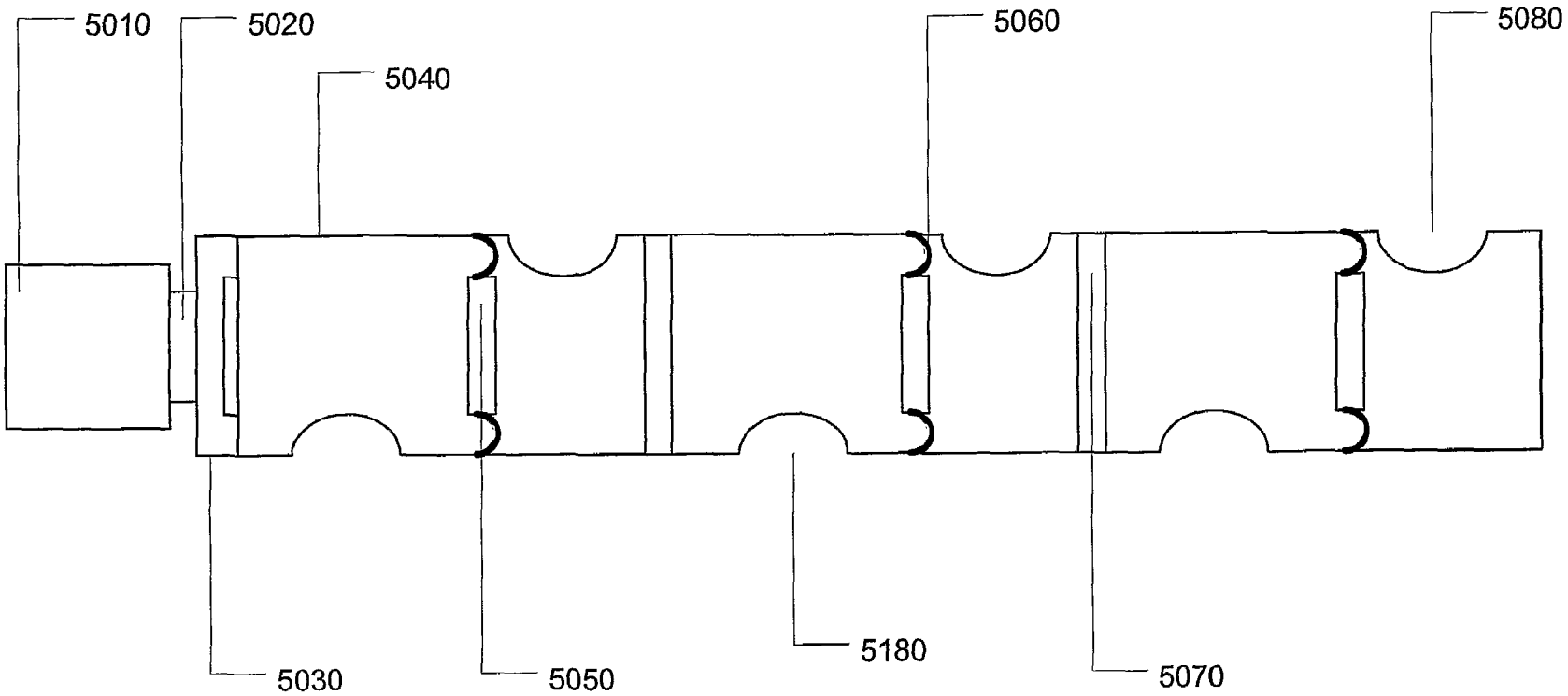
FIG. 5 is a schematic illustration of an implementation of the present invention using baffles, no drive rods and a single motor.

FIG. 5 shows one implementation of the invention in which an electromagnetic motor comprises a magnet 5010 and a voice coil 5020 to which is mounted a mechanical coupling 5030 that is coupled to a housing 5040. The housing is connected to the diaphragms 5050 by the suspensions 5060. Individual chambers are created by the baffles 5070. The sound waves from the front of the diaphragms are allowed to radiate to the listening environment through the openings 5080. The sound waves from the rear of the diaphragms are allowed to radiate through the openings 5180. Cancellation between the front and rear of the diaphragms is prevented or reduced substantially by the baffles 5070. At frequencies well below the resonance of the diaphragm/suspension assembly, the diaphragms move largely in phase with the housing and substantially no sound will be created. At frequencies well above the resonance of the diaphragm/suspension assembly, the diaphragms are almost motionless and the relative motion between the housing and the diaphragms creates sound. As a result, the resonant frequency of the diaphragm/suspension assembly can be chosen to achieve the desired frequency response of the transducer.

The suspensions need not all have identical properties or orientations. By varying the orientation of the suspensions as discussed above, asymmetrical characteristics of the suspensions may be cancelled or reduced so that distortion characteristics of the transducer may be reduced.

C. Modular Construction

FIGS. 6A-6C, 7, and 8 illustrate another implementation of the present invention that allows the acoustic transducer to be assembled in modules. Such a modular implementation may allow for greater manufacturability, flexibility, and performance as compared with a non-modular implementation.

Figures 6A, 6B, 6C:
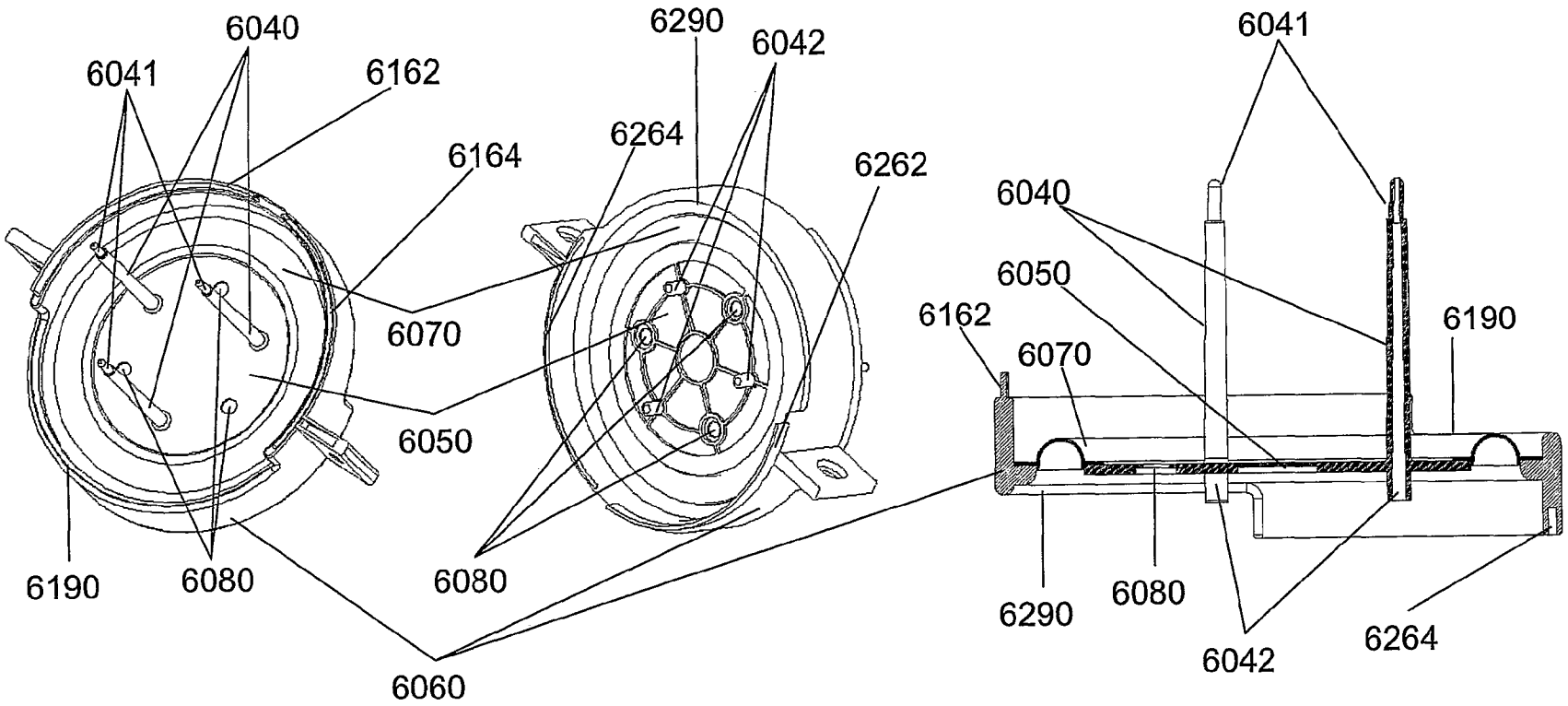
FIGS. 6A-6C are schematic illustrations of a diaphragm module that may be used to manufacture an acoustic transducer according to the present invention.

FIGS. 6A-6C illustrate one implementation of a diaphragm module. FIG. 6A shows a front view of the diaphragm module, FIG. 6B shows a rear view of the same diaphragm module, and FIG. 6C shows a cross-sectional view of the same diaphragm module. The diaphragm module includes a diaphragm 6050 that is attached via a suspension 6070 to the housing section 6060. The housing section 6060 incorporates an opening 6190 on the front side and another opening 6290 on the rear side. The housing section 6060 has protrusions 6162 on the front side and 6262 on the rear side, as well as corresponding slots 6164 on the front side and 6264 on the rear side, respectively. The diaphragm module also includes a section of three rods 6040, each of which has a protrusion 6041 on the front side and a matching opening 6042 on the rear side. The rods 6040 may be integrated with the diaphragm 6050 for improved structural integrity. Such a diaphragm/rod component could be manufactured, for example, using a material such as glass-filled or mica-filled polypropelene-polyphenylene-oxide-styrene in a molding process. The diaphragm 6050 has three openings 6080 to allow the rods of an adjacent diaphragm module to pass through the diaphragm 6050. If desired, diaphragm modules may have suspensions with different properties or different orientations as discussed above.

When two adjacent diaphragm modules are assembled together to form one implementation of a transducer, the front side of the first diaphragm is attached to the front side of the second diaphragm. The rods 6040 of the first diaphragm pass through the holes 6080 of the second diaphragm. The protrusion 6162 of each of the two diaphragm modules slide into the slot 6164 of the other module and may be bonded via an operation such as gluing or sonic welding. The front openings 6190 of the first and second diaphragms combine to create an opening for the front sound wave to be transmitted to the surrounding air. An assembly comprising two diaphragm modules that are assembled in this manner may be assembled with a third diaphragm module whose rear side is attached to the rear side of the second diaphragm module. The protrusion 6262 of each of the second and third diaphragm modules slide into the slot 6264 of the other module and may be bonded via an operation such as gluing or sonic welding. The rod protrusions 6041 of the first diaphragm slide into the rod openings 6042 of the third diaphragm and may be bonded via an operation such as gluing or sonic welding. The rear openings 6290 of the second and third diaphragms combine to create an opening for the rear sound wave to be vented to the surrounding air.

Figure 22B:
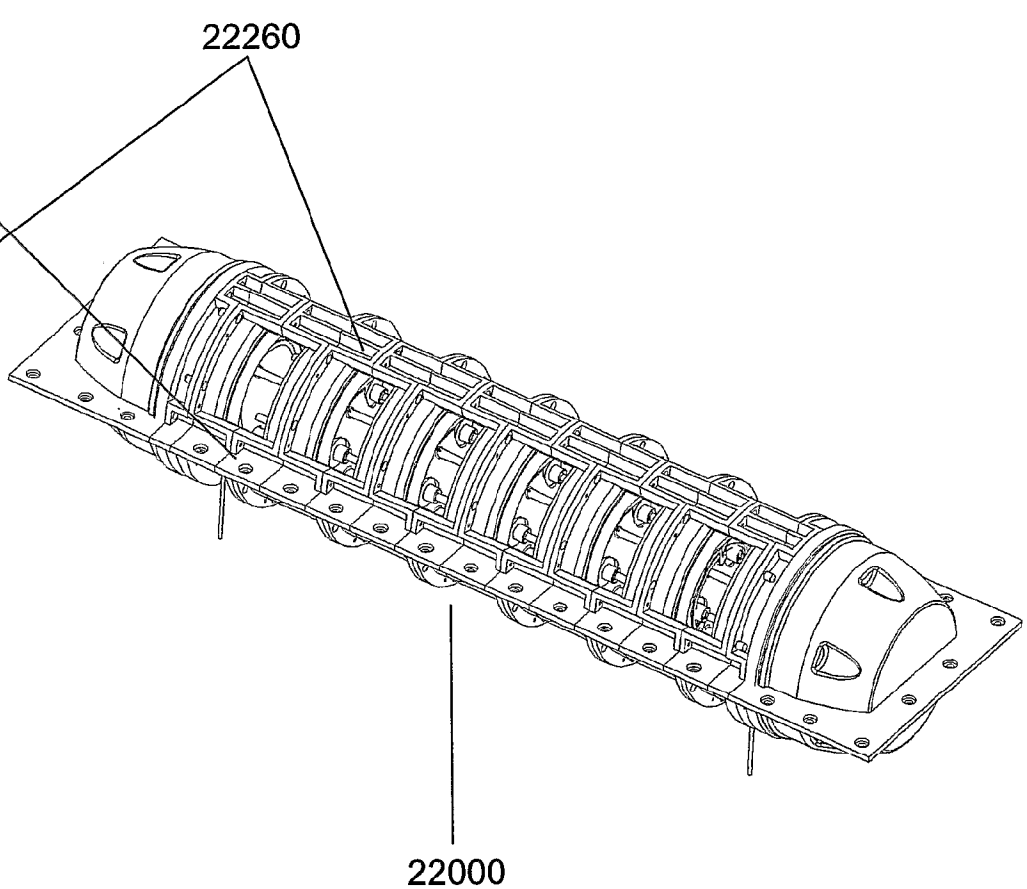
FIG. 22B is perspective schematic illustrations of an acoustic transducer comprising modular housing sections with ribs.
Figure 22A:
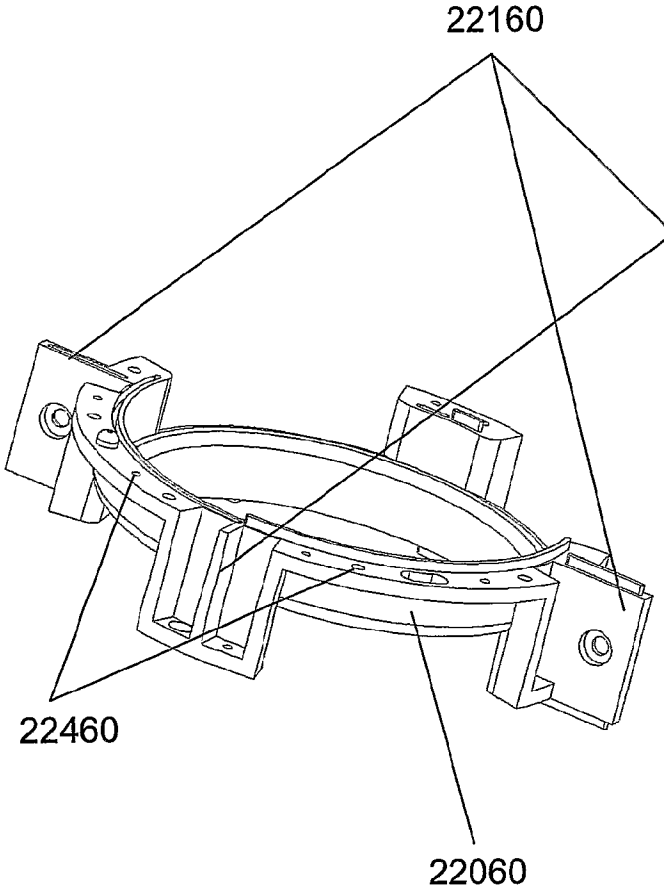
FIG. 22A is a schematic illustration of a diaphragm module housing section with ribs.

In preferred implementations, the housing section 6060 of a diaphragm module is made of a material that has sufficient strength and rigidity to provide a stable supporting structure for the diaphragms so that the transducer does not generate objectionable artifacts. If the housing section is made of a rigid plastic material such glass-filled or mica-filled polypropelene-polyphenylene-oxide-styrene, however, the rigidity of the resulting transducer may not be sufficient. In that case, the rigidity of the modular assembly may be improved by adding ribs to the outer wall of the housing section. FIG. 22A illustrates a housing section 22060 with integrated flanges 22160 and ribs 22260 on its outer surface. Adjacent housing sections may be attached to one another with glue and screws through the openings 22460 for additional rigidity. The resulting modular transducer assembly 22000 is shown in FIG. 22B.

The assembly procedure outlined above may be continued to add additional diaphragm modules to form a linear array of diaphragm modules of essentially any desired length. A second type of module, referred to herein as a motor module, includes a mechanical coupling that is designed to attach to the rear side of a diaphragm module.

Figure 7:
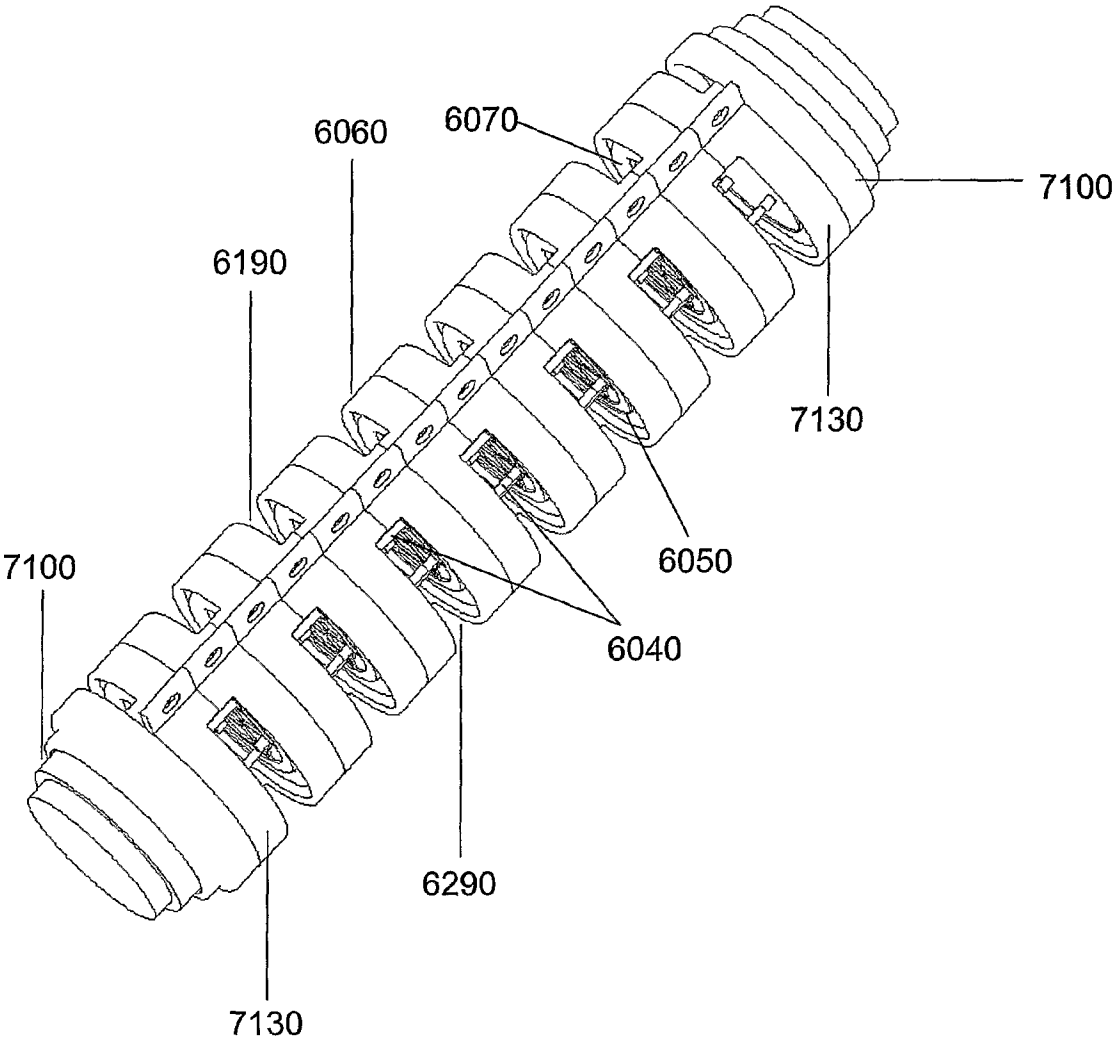
FIG. 7 is a schematic perspective illustration of an implementation of an acoustic transducer according to the present invention with a mechanically coupled drive using diaphragm modules like those illustrated in FIGS. 6A-6C.
Figure 8:
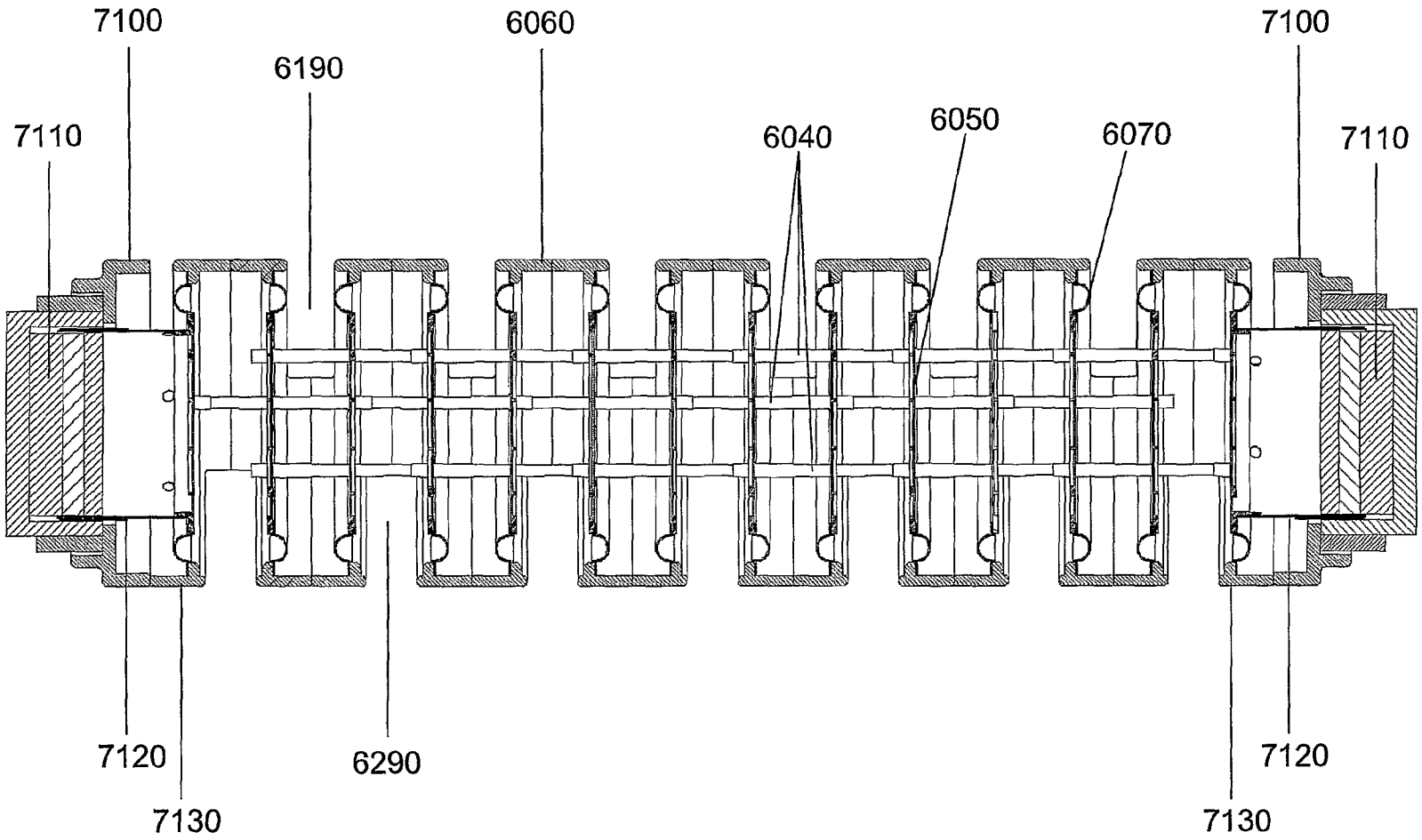
FIG. 8 is a schematic cross-sectional illustration of the transducer shown in FIG. 7.

A linear array of diaphragm modules may be assembled with one or more motor modules to create a complete transducer. For example, FIGS. 7 and 8 illustrate one implementation of a transducer according to the present invention that is composed of two motor modules 7100 and twelve diaphragm modules. Each motor module 7100 comprises a magnet assembly 7110, a coil 7120 and a mechanical coupling 7130 that connects the motor to a first diaphragm and from there to the other diaphragms through the rods 6040. The number of diaphragm modules that can be connected together in this fashion can be chosen to create a transducer of arbitrary length and arbitrary volume displacement, provided the motors have enough power to actuate the load presented by the selected number of diaphragm modules.

D. Fluidic Drive

Figure 9:
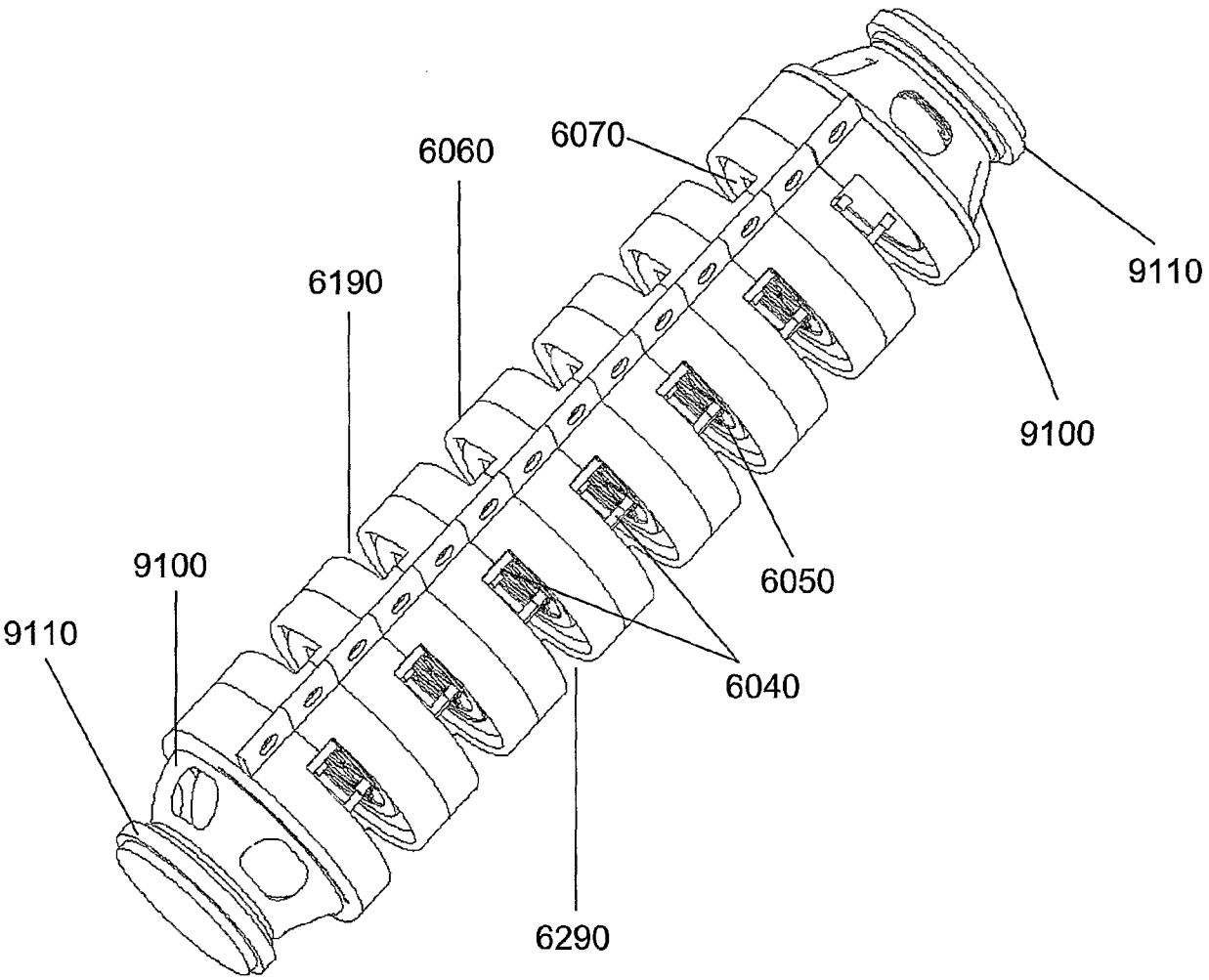
FIG. 9 is a schematic perspective illustration of an implementation of an acoustic transducer according to the present invention with a fluidically coupled drive using modules like those illustrated in FIGS. 6A-6C.
Figure 10:
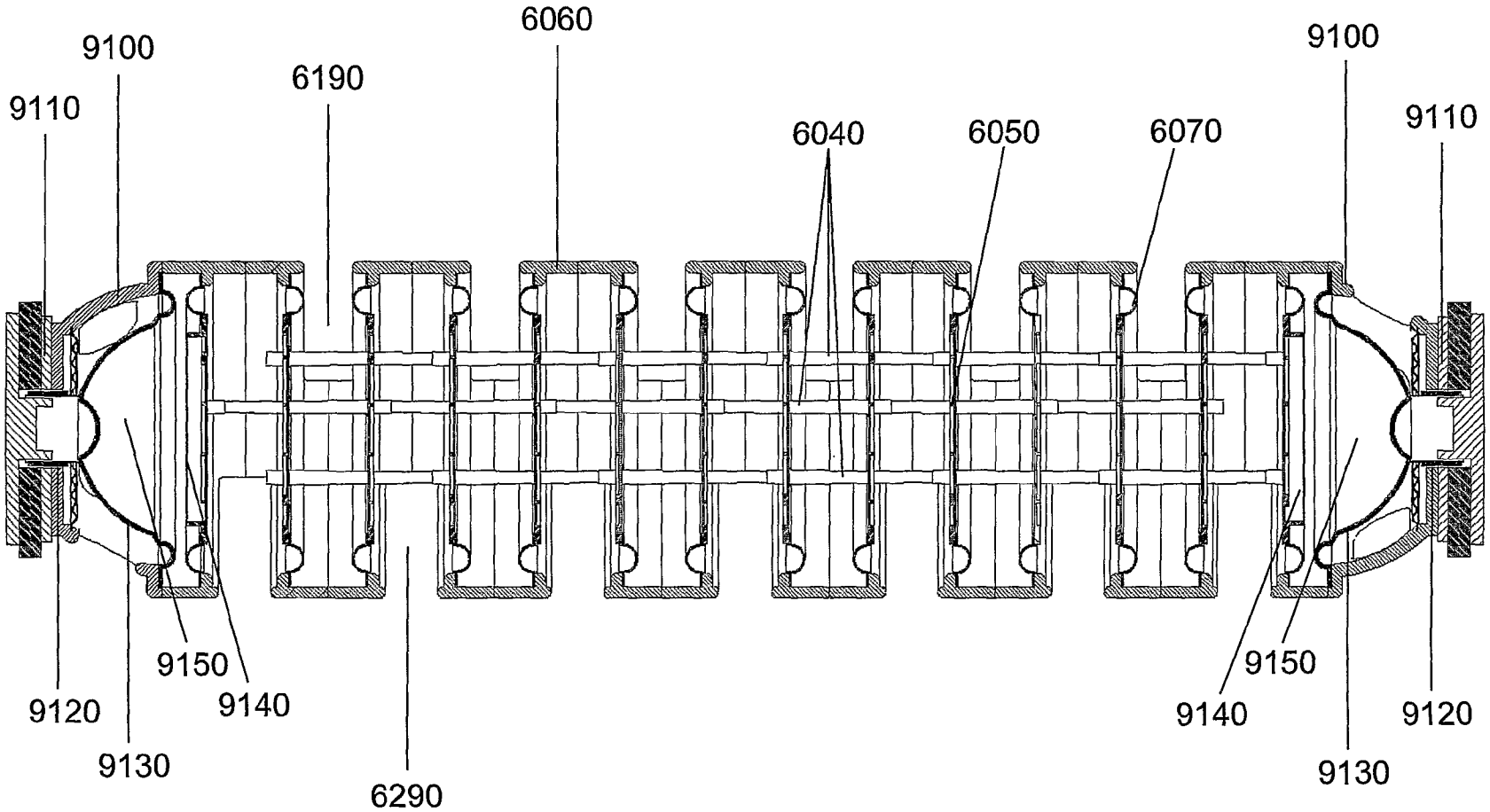
FIG. 10 is a schematic cross-sectional illustration of the transducer shown in FIG. 9.

FIG. 9 and FIG. 10 illustrate another implementation of the present invention in which the motor module 9100 is similar to a motor used in traditional transducers, and comprises a magnet assembly 9110, a coil 9120, and a cone 9130. The cone 9130 is fluidically coupled to the first diaphragm 9140 through the fluid contained in the sealed chamber 9150. The diaphragm 9140 is mechanically coupled to the remaining diaphragms 6050 through the rods 6040. The rear wave from the directly driven cones 9130 may contribute to the front waves of the diaphragms 6050. If the fluid used in the sealed chambers 9150 between the directly driven cones 9130 and indirectly driven diaphragms 6050 is a gas such as air, the fluidic drive includes a low pass filter. In this case, the directly driven cones 9130 may be driven to generate significant acoustic energy throughout their full frequency range while the indirectly driven diaphragms 6050 generate significant acoustic energy only at the lower frequencies.

E. Reduced Air Leakage Noise

FIGS. 11A-11C, 12A-12C, and 13A-13C illustrate three different techniques that may be used in various combinations to reduce undesirable air leakage noise through the pass-through openings of the diaphragms.

Figures 11A, 11B, 11C:
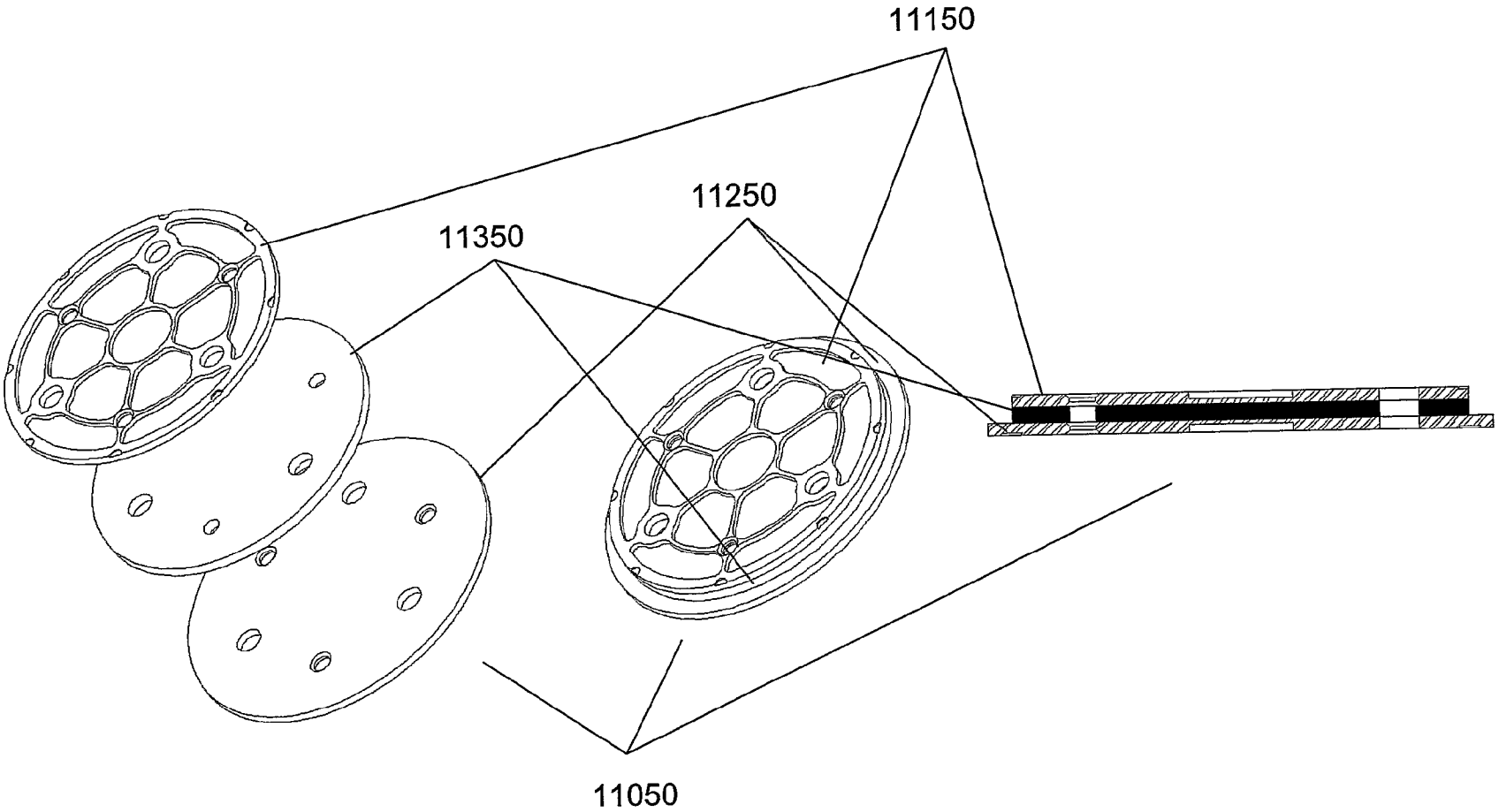
FIGS. 11A-11C are schematic illustrations of a composite diaphragm that is composed of two diaphragms with a layer of damping material sandwiched between them.

FIGS. 11A-11C illustrate one technique using a composite diaphragm 11050. FIG. 11A shows an exploded view of the composite diaphragm 11050 with two component diaphragms 11150 and 11250 and a layer of damping material 11350 between them. The layer of damping material 11350 may be attached to the component diaphragms 11150 and 11250 using a process such as gluing or molding. FIG. 11B shows a rear view and FIG. 11C shows a cross-sectional view of the composite diaphragm 11050.

Figures 12A, 12B, 12C:
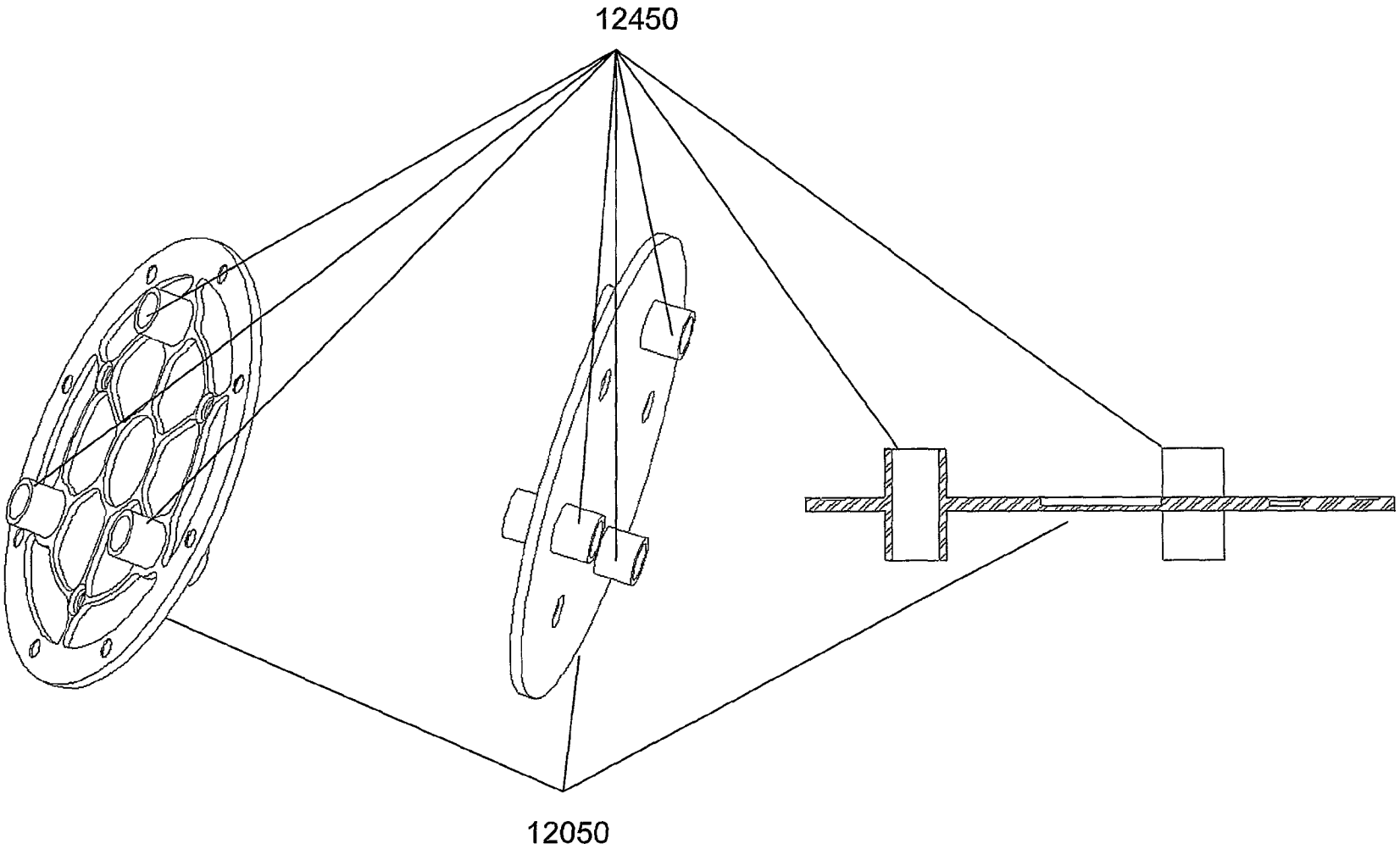
FIGS. 12A-12C are schematic illustrations of a diaphragm module with cylindrical sleeves around the pass-through openings.

FIGS. 12A-12C illustrate another technique using a diaphragm 12050 with sleeves around its pass-through openings. FIG. 12A shows a rear view, FIG. 12B shows a front view and FIG. 12C shows a cross-sectional view of the diaphragm 12050 with the sleeves 12450 around its pass-through openings.

Figures 13A, 13B, 13C:
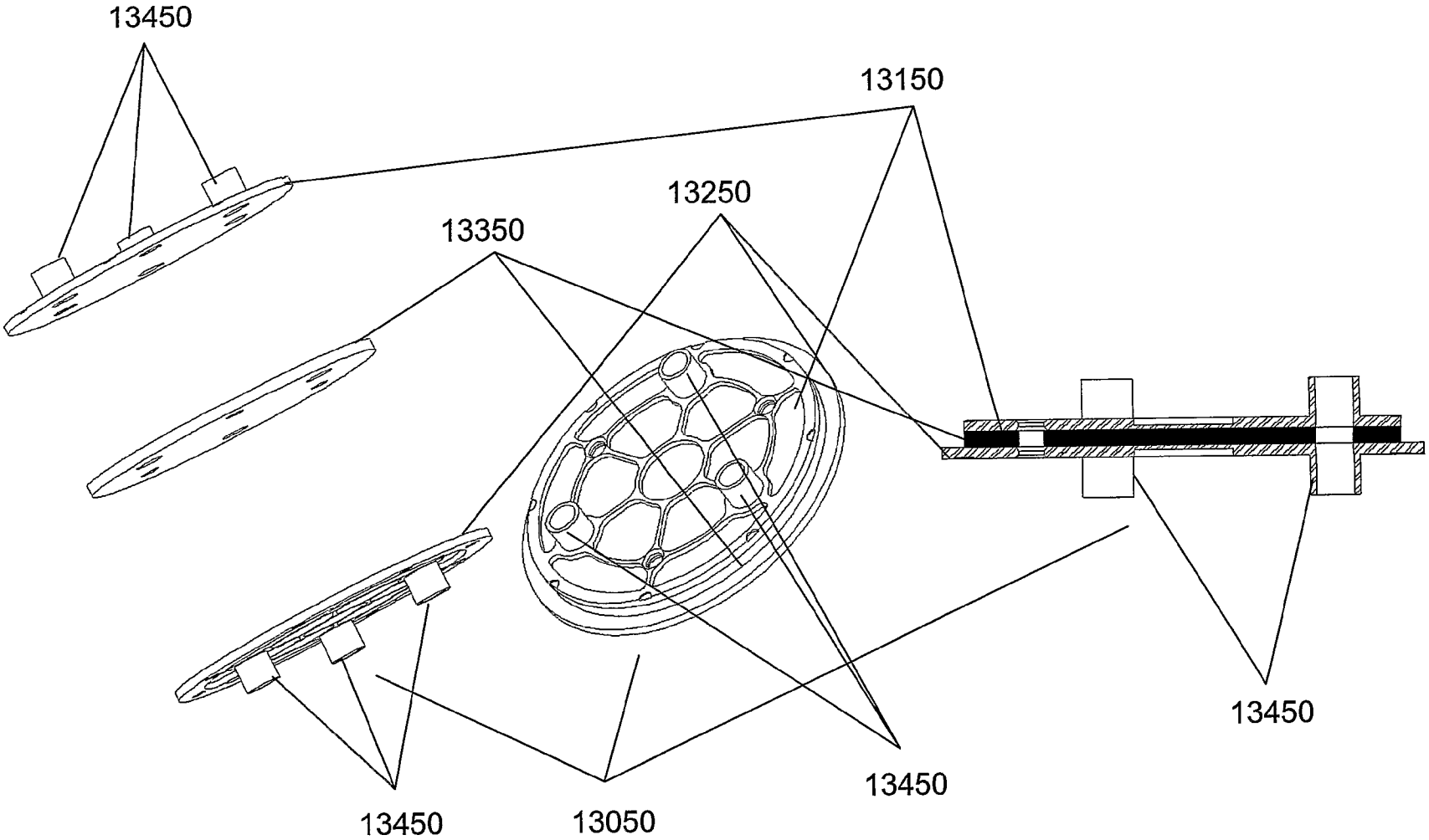
FIGS. 13A-13C are schematic illustrations of a composite diaphragm that is composed of two diaphragms, each with cylindrical sleeves around the pass-through openings on its outside face only, with a layer of damping material sandwiched between them.

FIGS. 13A-13C illustrate yet another technique using a composite diaphragm 13050 with sleeves around its pass-through openings. FIG. 13A shows an exploded view of the composite diaphragm 13050 with two component diaphragms 13150 and 13250 and a layer of damping material 13350 between them. The layer of damping material 13350 may be attached to the component diaphragms 13150 and 13250 using a process such as gluing or molding. The two component diaphragms 13150 and 13250 each have sleeves 13450 around their corresponding pass-through openings. The sleeves are formed on the outside face of each component diaphragm, which is the side that faces away from the damping material 13350. FIG. 13B shows a rear view and FIG. 13C shows a cross-sectional view of the composite diaphragm 13050.

Figure 14B:
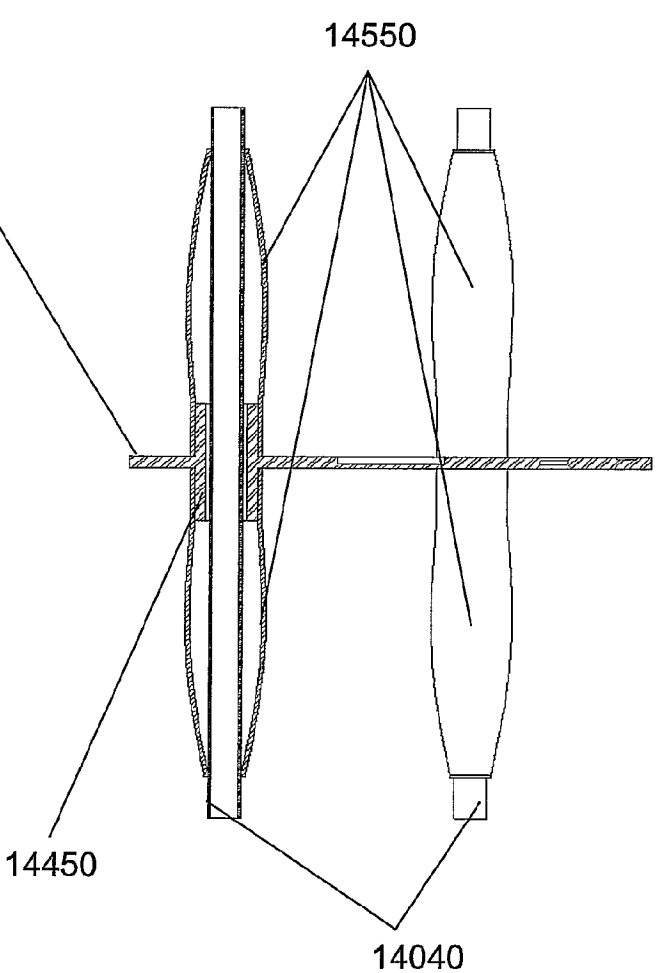
FIGS. 14A-14B are schematic illustrations of a diaphragm with cylindrical sleeves around the pass-through openings and soft fabric sleeves around the cylindrical sleeves.
Figure 14A:
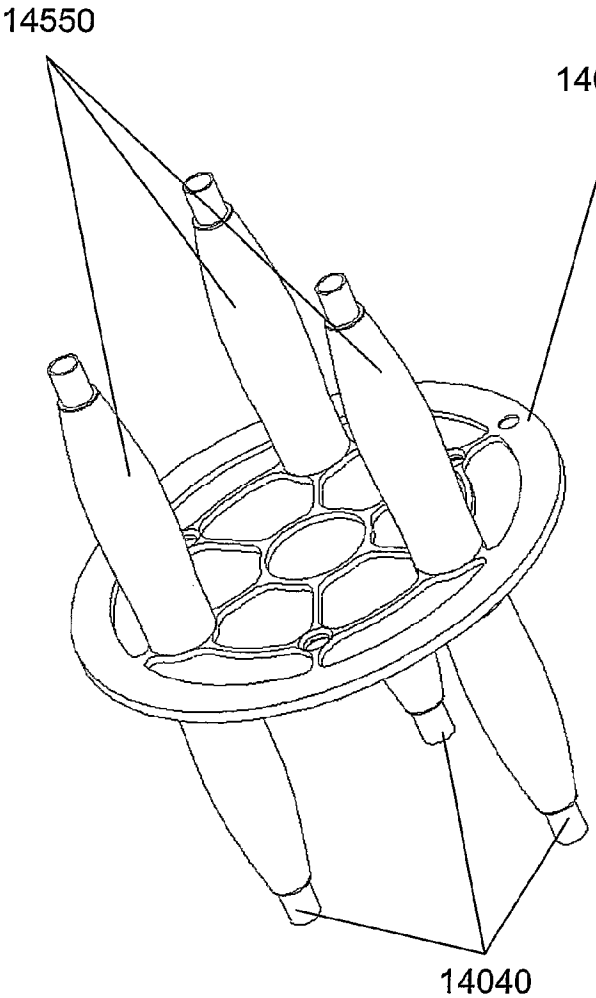

FIGS. 14A-14B illustrate another technique using a diaphragm 14050 with hard sleeves and soft fabric sleeves around its pass-through openings. FIG. 14A shows a side view and FIG. 14B shows a cross-sectional view of the resulting subassembly, which includes the diaphragm 14050 with hard cylindrical sleeves 14450 around each of its pass-through openings on both sides of the diaphragm 14050. The soft fabric sleeves 14550 are attached to the outside of the hard sleeves 14450 and extend past them, almost touching the rods 14040 that slide through the pass-through openings of the diaphragm 14050.

Figure 15B:
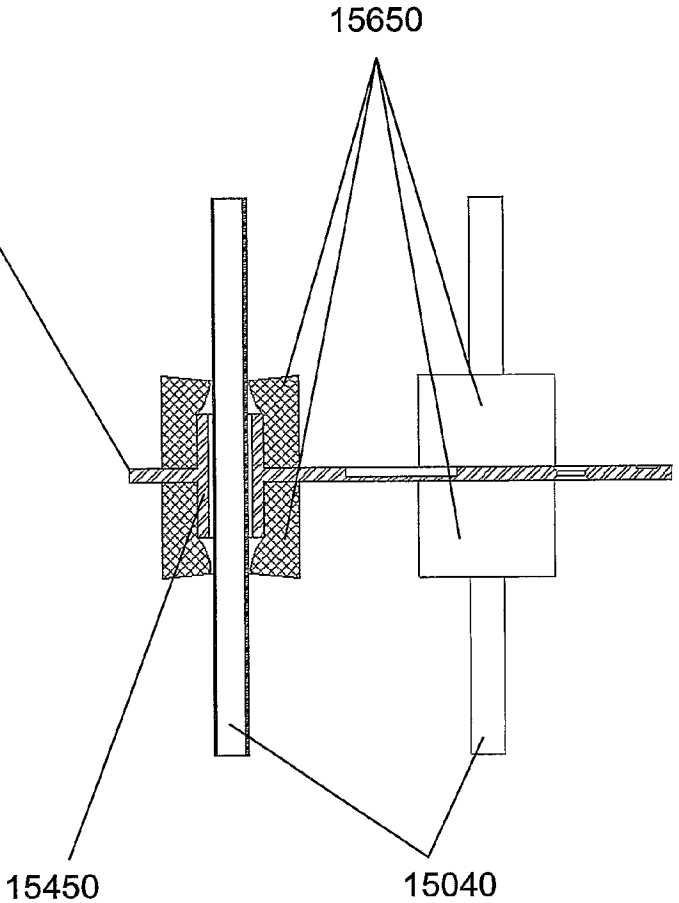
FIGS. 15A-15B are schematic illustrations of a diaphragm with cylindrical sleeves around the pass-through openings and soft foam sleeves around the cylindrical sleeves.
Figure 15A:
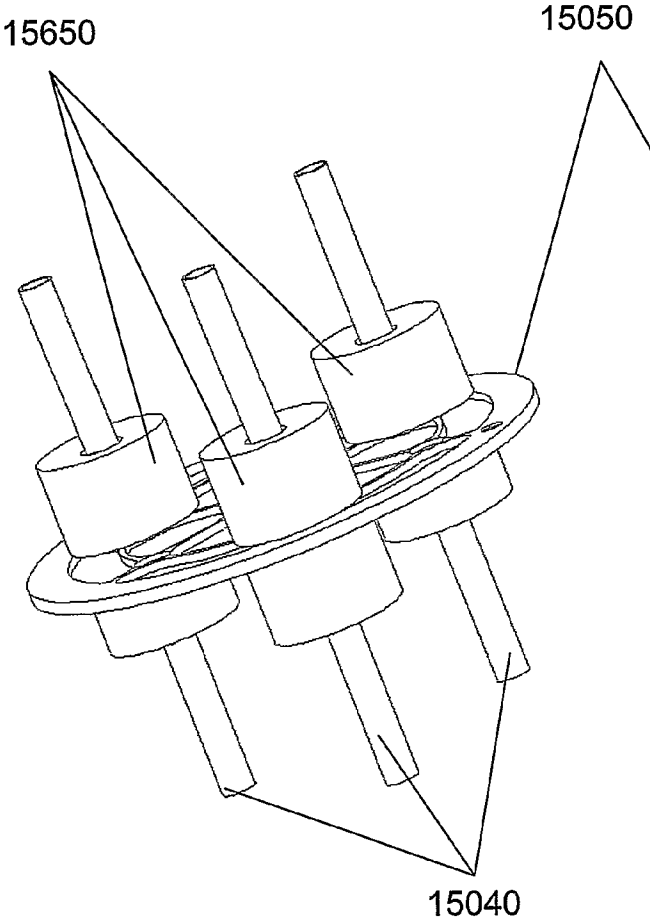

FIGS. 15A-15B illustrate another technique using a diaphragm 15050 with hard sleeves and soft foam sleeves around its pass-through openings. FIG. 15A shows a side view and FIG. 15B shows a cross-sectional view of the resulting subassembly, which includes the diaphragm 15050 with hard cylindrical sleeves 15450 around each of its pass-through openings on both sides of the diaphragm 15050. The soft foam sleeves 15650 are attached to the outside of the hard sleeves 15450 and preferably extend past them, curving in and almost touching the rods 15040 that slide through the pass-through openings of the diaphragm 15050.

Figure 16B:
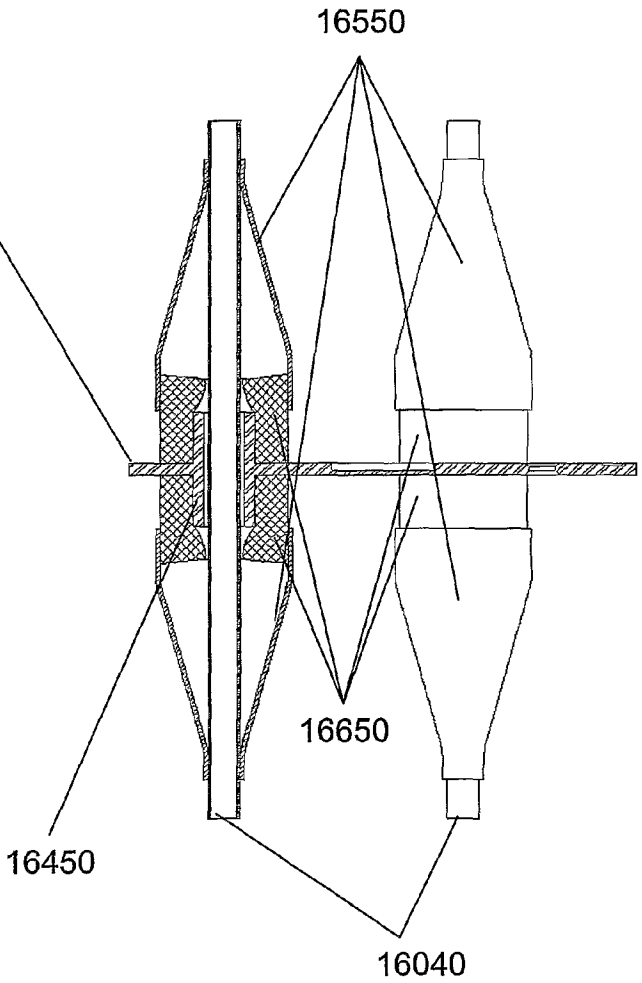
FIGS. 16A-16B are schematic illustrations of a diaphragm with cylindrical sleeves around the pass-through openings, soft foam sleeves around the cylindrical sleeves, and soft fabric sleeves around the foam sleeves.
Figure 16A:
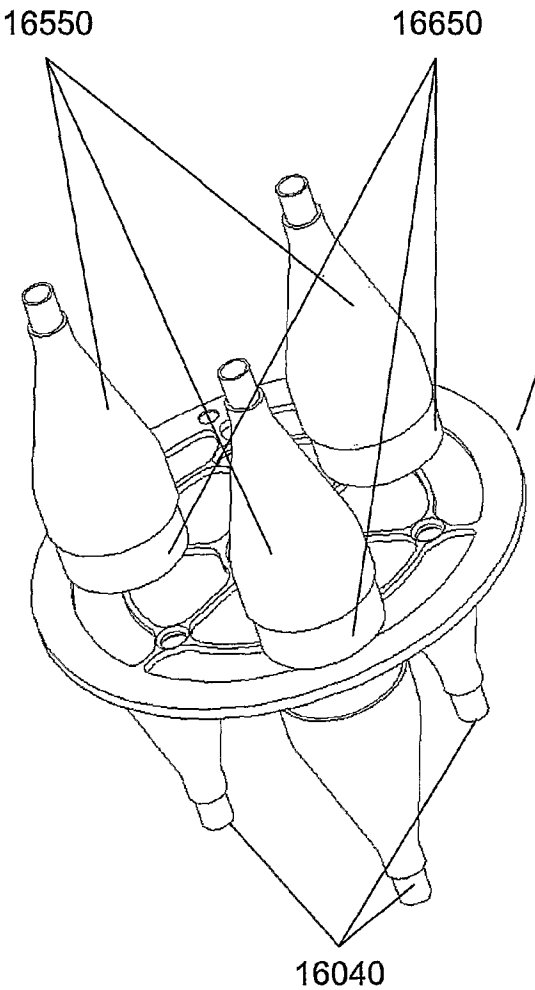

FIGS. 16A-16B illustrate another technique using a diaphragm 16050 with hard sleeves, soft foam sleeves, and soft fabric sleeves around its pass-through openings. FIG. 16A shows a side view and FIG. 16B shows a cross-sectional view of the resulting subassembly, which includes the diaphragm 16050 with hard cylindrical sleeves 16450 around each of its pass-through openings on both sides of the diaphragm 16050. The soft foam sleeves 16650 are attached to the outside of the hard sleeves 16450. The soft fabric sleeves 16550 are attached to the outside of the soft foam sleeves 16650 and extend past them, almost touching the rods 16040 that slide through the pass-through openings of the diaphragm 16050.

Figure 17B:
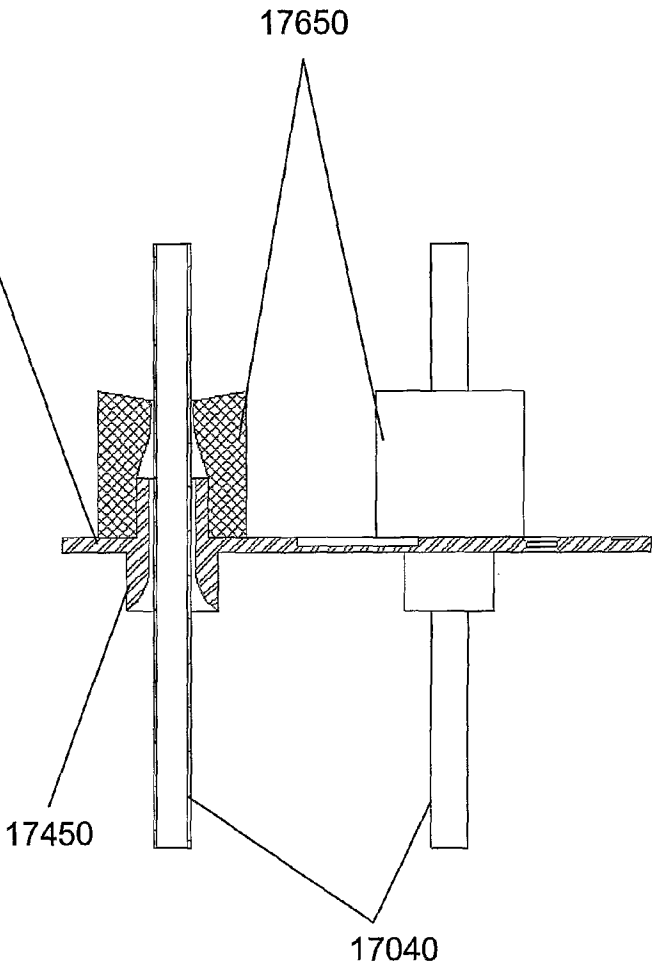
FIGS. 17A-17B are schematic illustrations of a diaphragm with funnel-shaped cylindrical sleeves around the pass-through openings on the outside face of the diaphragm and, on the inside face, cylindrical sleeves around the pass-through openings with soft foam sleeves around the cylindrical sleeves.
Figure 17A:
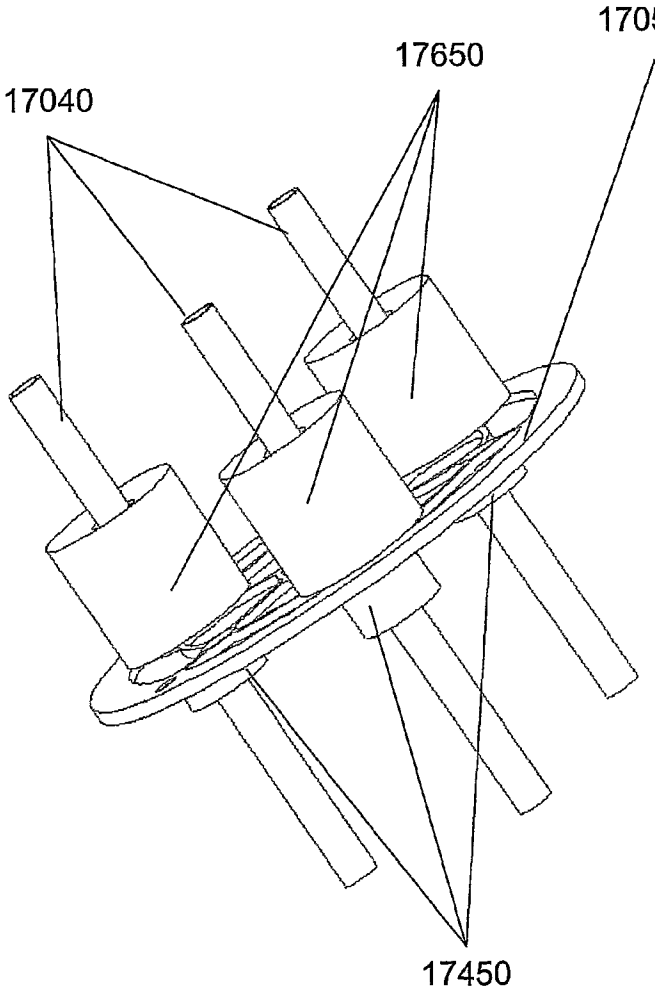

FIGS. 17A-17B illustrate yet another technique using a diaphragm 17050 with hard sleeves and soft foam sleeves around its pass-through openings. FIG. 17A shows a side view and FIG. 17B shows a cross-sectional view of the resulting subassembly, which includes the diaphragm 17050 with hard cylindrical sleeves 17450 around each of its pass-through openings on both sides of the diaphragm 17050. The soft foam sleeves 17650 are attached to the outside of the hard sleeves 17450 only on the inside face of the diaphragm 17050, and they tightly touch the rods 17040 to further reduce resistance to air flow. The sleeves 17450 have a funnel shape on the outside face of the diaphragm 17050 to provide a greater reduction in air leakage noise.

Figures 18A, 18B:
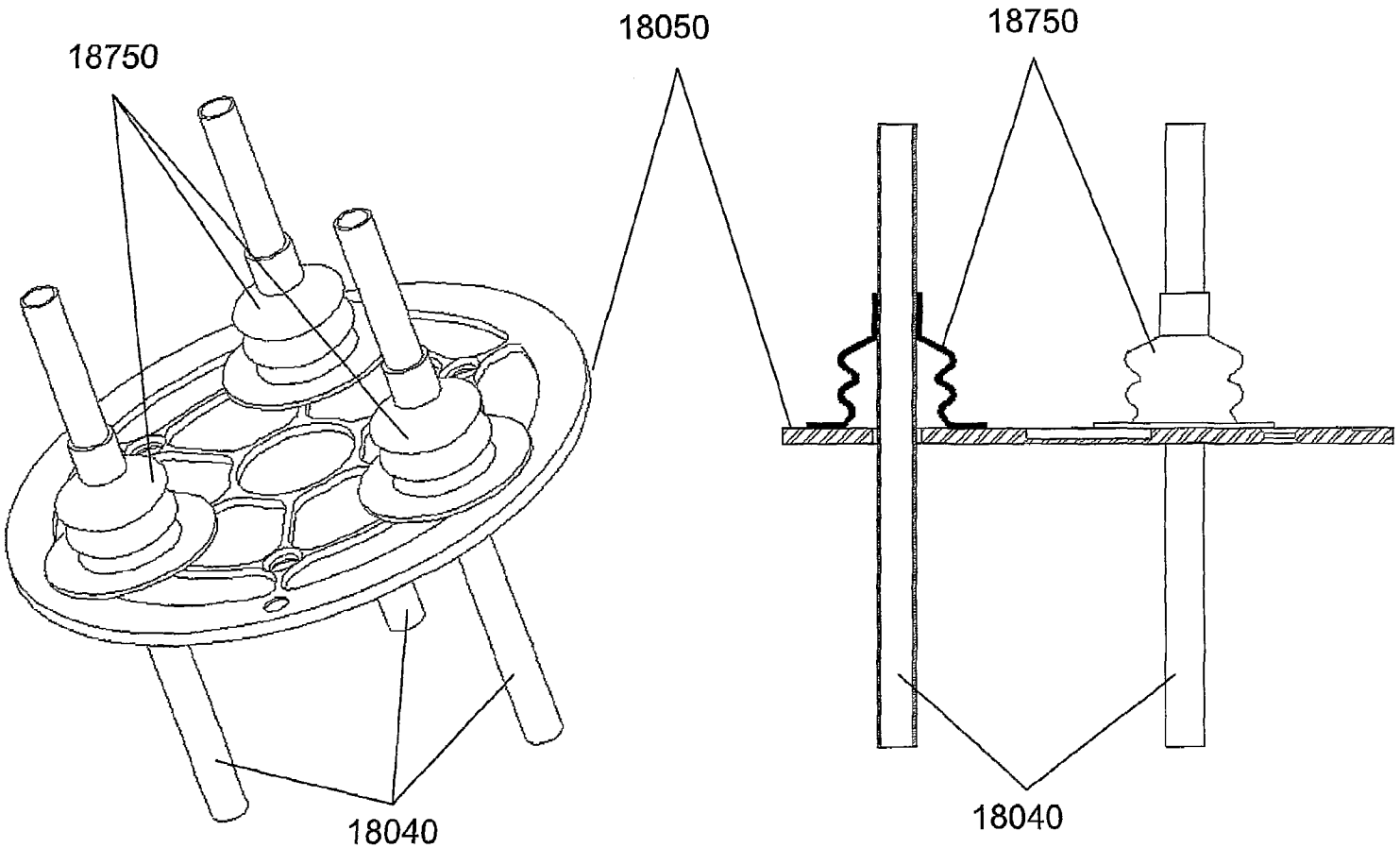
FIGS. 18A-18B are schematic illustrations of a diaphragm with soft bellows around the pass-through openings on its inside face only.

FIGS. 18A-18B illustrate a technique for preventing air leakage using a diaphragm 18050 with soft bellows around its pass-through openings. FIG. 18A shows a side view and FIG. 18B shows a cross-sectional view of the resulting subassembly, which includes the diaphragm 18050 with soft bellows 18750 on its inside face. One side of the bellows 18750 is connected to the diaphragm 18050 around each of its pass-through openings. The other side of the bellows 18750 is connected to the rod 18040. The soft bellows 18750 stretch and contract as the diaphragm 18050 and the rods 18040 move relative to each other.

Figures 19A, 19B:
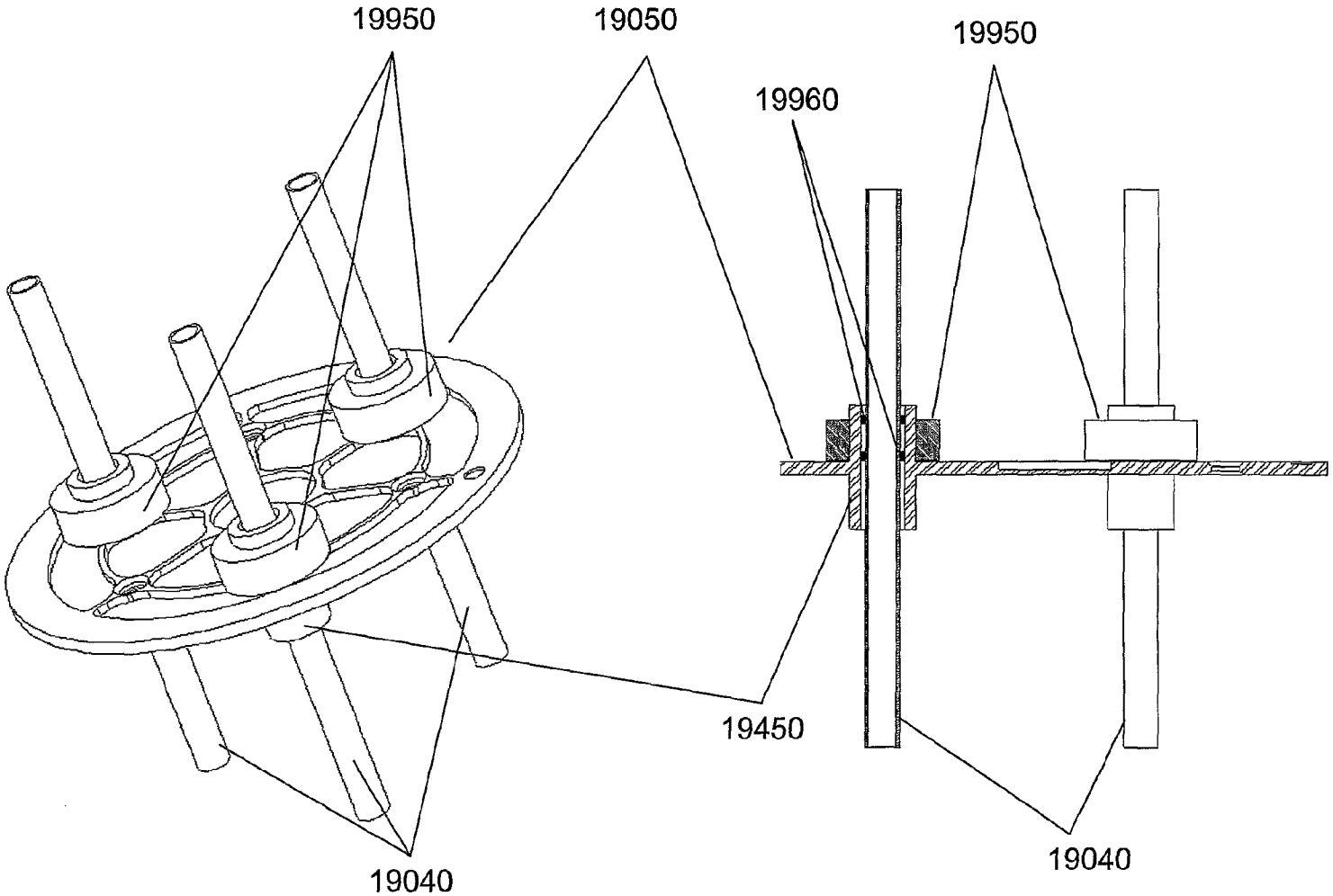
FIGS. 19A-19B are schematic illustrations of a diaphragm with cylindrical sleeves around the pass-through openings, ring magnets around the sleeves on its inside face only, and ferromagnetic liquid between the sleeves and the drive rods.

FIGS. 19A-19B illustrate another technique for preventing air leakage using a diaphragm 19050 with hard sleeves, ring magnets, and ferromagnetic liquid. FIG. 19A shows a side view and FIG. 19B shows a cross-sectional view of the resulting subassembly, which includes the diaphragm 19050 with hard cylindrical sleeves 19450 around each of its pass-through openings on both sides of the diaphragm 19050. The ring magnets 19950 are attached to the outside of the hard sleeves 19450 on the inside face of the diaphragm 19050, and they are preferably polarized in the vertical direction for improved efficiency. The ferromagnetic liquid 19960 is placed between the sleeves 19450 and the rods 19040, and is held in place by the magnetic force of the ring magnets 19950 as the rods 19040 move relative to the diaphragm 19050.

Figures 20A, 20B:
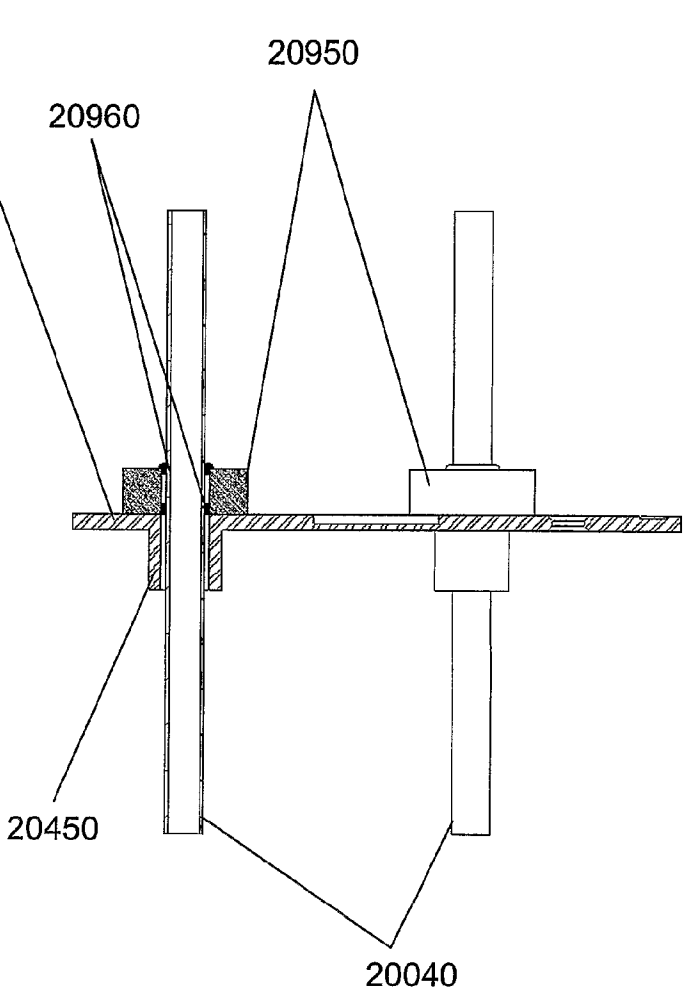
FIGS. 20A-20B are schematic illustrations of a diaphragm with cylindrical sleeves around the pass-through openings on its outside face only, ring magnets around the pass-through openings on its inside face only, and ferromagnetic liquid between the magnets and the drive rods.

FIGS. 20A-20B illustrate another technique for preventing air leakage using a diaphragm 20050 with hard sleeves, ring magnets, and ferromagnetic liquid. FIG. 20A shows a side view and FIG. 20B shows a cross-sectional view of the resulting subassembly, which includes the diaphragm 20050 with hard cylindrical sleeves 20450 around its pass-through openings on the outside face of the diaphragm. The ring magnets 20950 are attached around the diaphragm 20050 on the inside face of the diaphragm 20050, and they are preferably polarized in the vertical direction for improved efficiency. The ferromagnetic liquid 20960 is placed between the ring magnets 20950 and the rods 20040, and is held in place by the magnetic force of the ring magnets 20950 as the rods 20040 move relative to the diaphragm 20050.

Figure 21B:
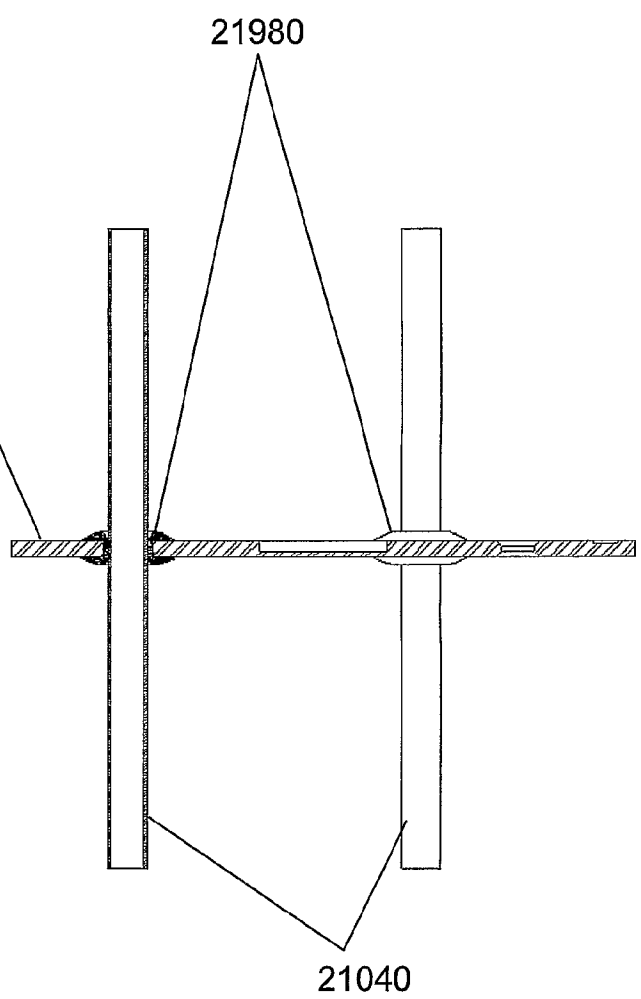
FIGS. 21A-21B are schematic illustrations of a diaphragm with a semifluid lubricant covering the pass-through openings.
Figure 21A:
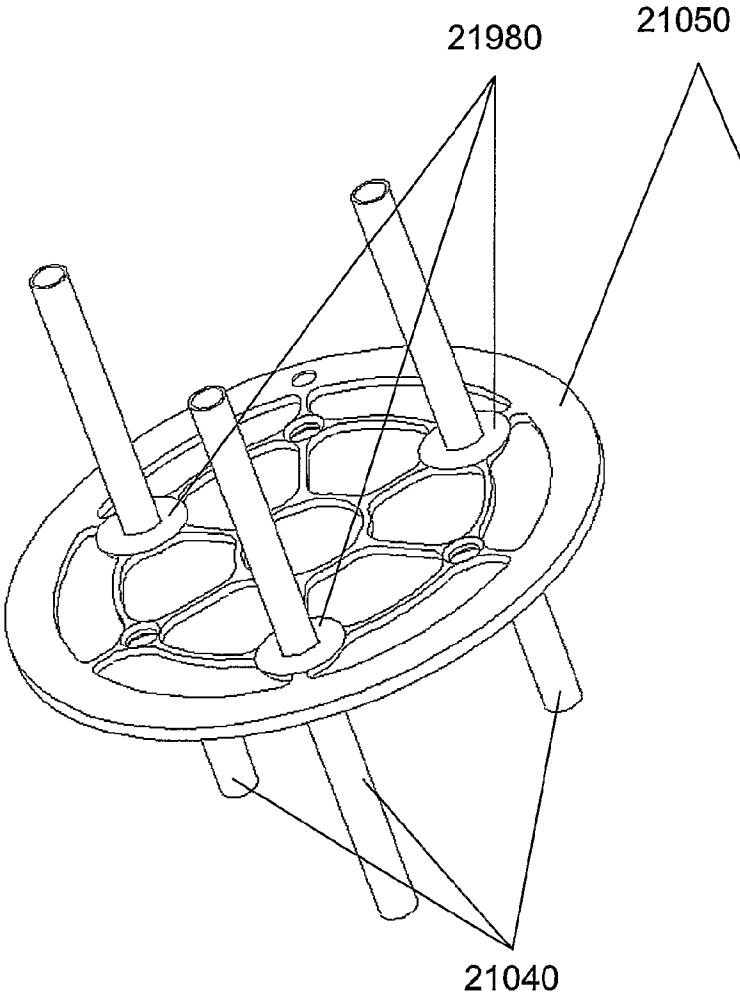

FIGS. 21A-21B illustrate another technique for preventing air leakage using a diaphragm 21050 with a semifluid lubricant, such as a thixotropic gel. FIG. 21A shows a side view and FIG. 21B shows a cross-sectional view of the resulting subassembly, which includes the diaphragm 21050 with the semifluid lubricant 21980 covering its pass-through openings on both sides of the diaphragm. The lubricant 21980 allows the rods 21040 to slide through the openings but otherwise seals the openings to essentially eliminate air flow through the openings.

The thickness of the diaphragm and the length of the sleeves may be adjusted so that the total length of the air path through the pass-through openings is as short as 2 mm or as long as 25 mm or more. The air path length may be set according to the needs of the application and the desired level of audio quality. A path length of about 15 mm is preferred for many applications.

The drawings illustrate implementations of acoustic transducers that have flat or planar diaphragms. The shape of the diaphragms is not critical in principle. Other shapes such as cones or domes may be used.

Figures 23A, 23B, 23C:
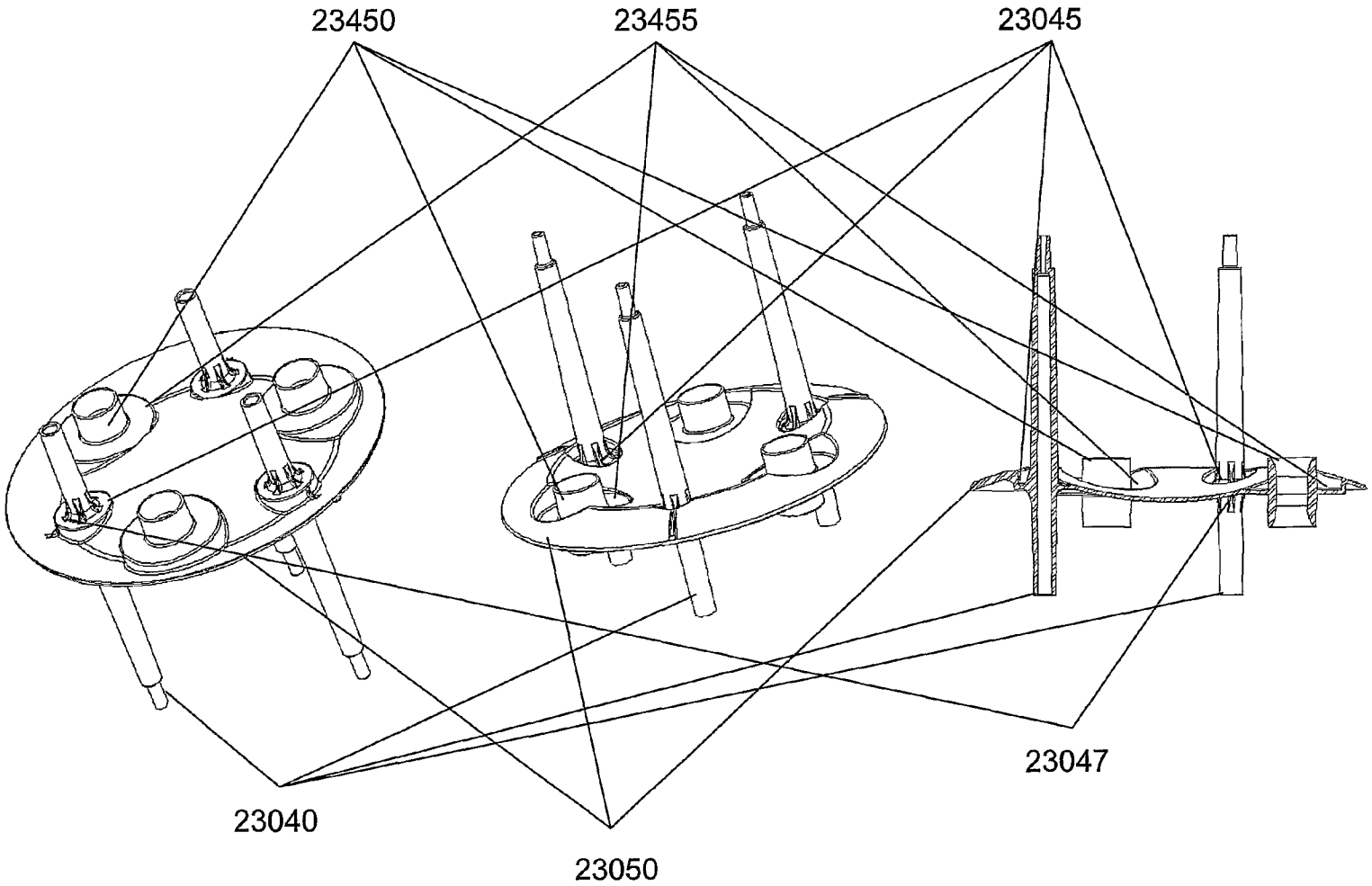
FIGS. 23A-23C are schematic illustrations of a dome-shaped diaphragm with integrated rods and sleeves.

FIGS. 23A-23C illustrate a dome-shaped diaphragm 23050 with integrated rods 23040 and sleeves 23450. FIG. 23A shows a front side view, FIG. 23B shows a rear side view, and FIG. 23C shows a cross-sectional view of the diaphragm 23050. Because of the dome shape of the diaphragm, flat landings are added to accommodate air leakage reduction components and improve rigidity. The flat landings 23455 surrounding the sleeves 23450 are used to attach components for reducing air leakage noise such as, for example the soft foam sleeves 17650 shown in FIG. 17 or the ring magnets 19950 shown in FIG. 19. The flat landings 23045 surrounding the rods 23040 are added to make the diaphragm 23050 more amenable to volume manufacturing methods such as injection molding. The gussets 23047 are also added for structural support of the joint between the rods 23040 and the landing 23045. The flat landings 23045 and 23455 are pushed towards the front side of the diaphragm 23050 to increase the clearance between neighboring diaphragms, which increases the maximum allowed excursion of the overall transducer.

Figures 24A, 24B:
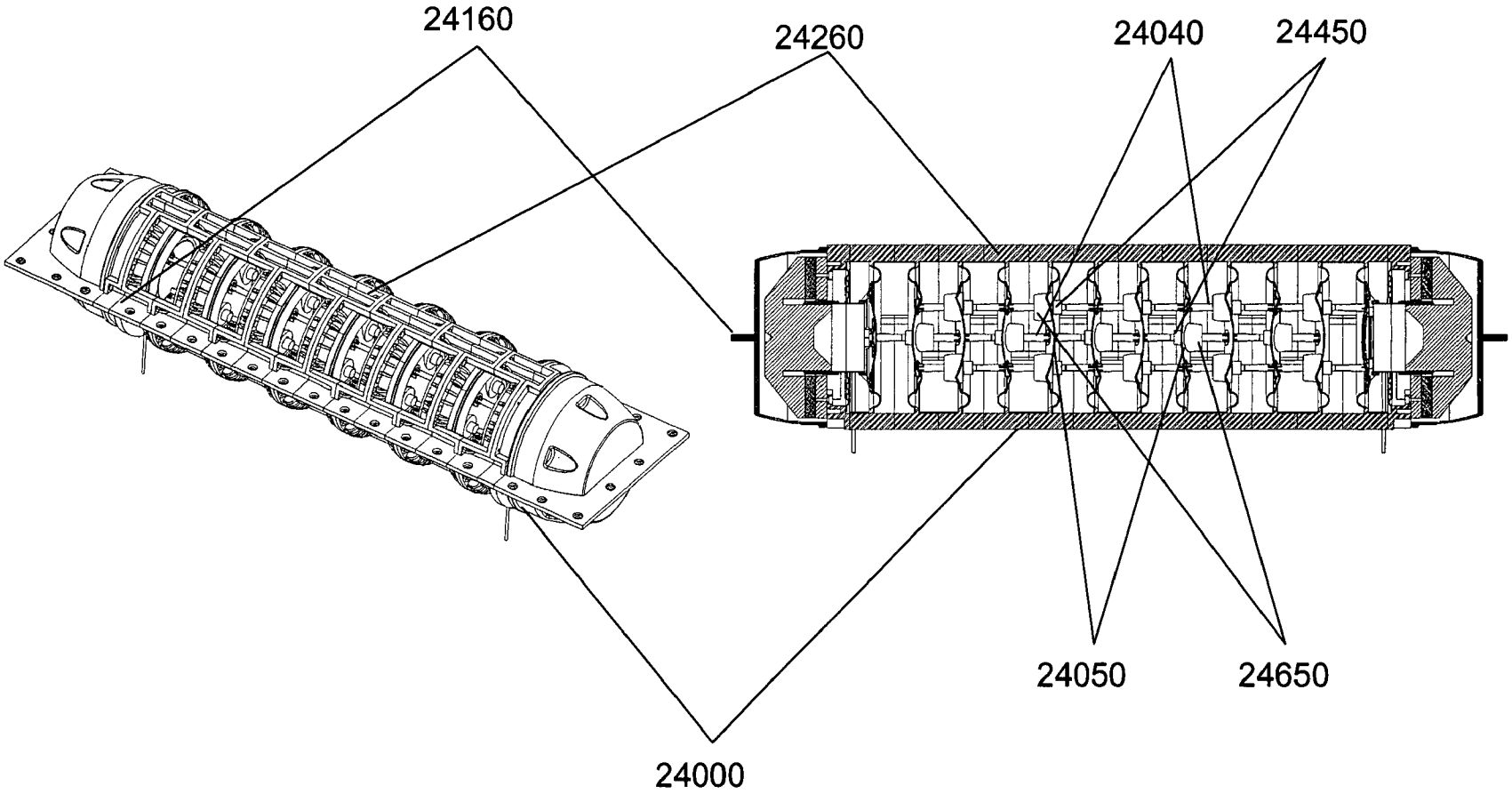
FIG. 24A is a perspective schematic illustration of a modularly constructed transducer comprising modular housing sections with ribs and dome-shaped diaphragms with soft foam sleeves.
FIG. 24B is a schematic cross-sectional illustration of a modularly constructed transducer with dome-shaped diaphragms and soft foam sleeves.

FIG. 24A shows a perspective view and FIG. 24B shows a cross-sectional view of a modularly assembled transducer 24000 with integrated flanges 24160 and ribs 24260 on its outer surface, and dome-shaped diaphragms 24050 with integrated rods 24040 and sleeves 24450 that are surrounded on their rear side by soft foam sleeves 24650.

The invention claimed is:

1. An acoustic transducer comprising:

a housing;

a plurality of diaphragms suspended from the housing and arranged in a group;

an opening delimited between two adjacent diaphragms which extends from an interior of the housing to an exterior of the housing; and a motor coupled with the housing and configured to operate in response to an electrical signal;

wherein the diaphragms of the group are driven by the motor to which all the diaphragms in the group are associated;

wherein the motor has an indirect coupling with no direct mechanical connection to the diaphragms that it drives; and wherein a sound generated by the transducer passes through the opening to the exterior of the housing.

2. The acoustic transducer of claim 1, in which the indirect coupling comprises the motor being connected to the housing.

3. The acoustic transducer of claim 1 in which the indirect coupling is a gas or liquid fluid that couples the motor to the diaphragms.

4. The acoustic transducer of claim 3, in which the motor is coupled to a first diaphragm and the fluid couples the first diaphragm to a second diaphragm that is in the group of diaphragms.

5. The acoustic transducer of claim 4 in which the fluid is contained in a sealed chamber between the first diaphragm and the second diaphragm.

6. The acoustic transducer of claim 1, wherein the acoustic transducer is formed from: a plurality of diaphragm modules coupled to one another, each diaphragm module comprising a section of the housing and one or more of the diaphragms coupled to the section of the housing; and one or more motor modules coupled to one or more of the diaphragm modules, each of the motor modules comprising one or more motors.

7. The acoustic transducer of claim 6, wherein a respective diaphragm module comprises one or more rods that are coupled to its one or more diaphragms.

8. The acoustic transducer of claim 7 in which at least some of the rods pass through openings in the diaphragms.

9. The acoustic transducer of claim 7, wherein the one or more rods in a first diaphragm module connect to a diaphragm in a second diaphragm module and are routed such that they circumvent a third diaphragm module that is interposed between the first and second diaphragm modules.

10. The acoustic transducer of claim 1, comprising two groups of diaphragms and two motors, each motor actuating diaphragms in a respective group, and wherein the groups of diaphragms are driven in opposition to one another.

11. The acoustic transducer of claim 1, wherein two or more of the diaphragms are each suspended from the housing by a suspension, and the suspensions for the two or more diaphragms have different properties or orientations.

12. The acoustic transducer of claim 11, wherein some of the diaphragms in a group have suspensions with a first orientation and other diaphragms in the group have suspensions with a second orientation that is opposite to the first orientation.

13. The acoustic transducer of claim 1, wherein the group of diaphragms comprises three or more diaphragms.

14. The acoustic transducer of claim 1, wherein the diaphragms of the group are mechanically connected by a rod.

15. The acoustic transducer of claim 1, wherein the motor comprises a first motor disposed at a first end of the transducer and a second motor disposed at a second end of the transducer opposite from the first end.

* * * * *